US008986140B1

(12) United States Patent
Fuller

(10) Patent No.: US 8,986,140 B1
(45) Date of Patent: Mar. 24, 2015

(54) AIMING AID FOR BASKETBALL BANK SHOT AND METHOD OF USE THEREOF

(71) Applicant: Daniel R. Fuller, Prospect, KY (US)

(72) Inventor: Daniel R. Fuller, Prospect, KY (US)

( * ) Notice: Subject to any disclaimer, the term of this patent is extended or adjusted under 35 U.S.C. 154(b) by 0 days.

(21) Appl. No.: 14/035,140

(22) Filed: Sep. 24, 2013

Related U.S. Application Data

(63) Continuation-in-part of application No. 13/175,008, filed on Jul. 1, 2011, now abandoned.

(51) Int. Cl.
*A63B 69/00* (2006.01)
*A63B 63/08* (2006.01)

(52) U.S. Cl.
CPC ..... *A63B 69/0071* (2013.01); *A63B 63/083* (2013.01)
USPC ..... 473/447; 473/422

(58) Field of Classification Search
CPC ..... A63B 63/083; A63B 2207/02; A63B 69/0071; A63B 2225/093; A63B 2243/0037; A63B 63/00
USPC ..... 473/422, 433, 447, 449, 479, 480, 481, 473/483, 472; D21/703; 434/248
See application file for complete search history.

(56) References Cited

U.S. PATENT DOCUMENTS

| | | | | |
|---|---|---|---|---|
| 2,805,861 | A | 9/1957 | Lopas | |
| 3,598,407 | A | 8/1971 | Sorensen | |
| 4,183,522 | A | 1/1980 | Killen | |
| D330,059 | S | 10/1992 | McGivern et al. | |
| 5,305,998 | A | 4/1994 | Nesbit et al. | |
| 5,695,415 | A | 12/1997 | Docherty et al. | |
| 5,800,296 | A | 9/1998 | Shaw | |
| 5,829,751 | A | 11/1998 | Willis | |
| 5,842,699 | A * | 12/1998 | Mirando et al. | 473/448 |
| 5,902,198 | A * | 5/1999 | Martin et al. | 473/481 |
| 6,367,948 | B2 | 4/2002 | Branson | |
| 6,398,673 | B1 * | 6/2002 | Maruca | 473/481 |
| 6,402,644 | B2 | 6/2002 | Stanford et al. | |
| 6,447,409 | B1 * | 9/2002 | Squibb | 473/486 |
| 6,554,724 | B2 | 4/2003 | Taylor | |
| D482,417 | S * | 11/2003 | Oister et al. | D21/702 |
| 6,758,768 | B2 | 7/2004 | Spencer | |
| 6,843,738 | B2 * | 1/2005 | Spencer | 473/472 |
| 6,984,129 | B1 | 1/2006 | Jordan | |
| 7,052,418 | B2 * | 5/2006 | Nye et al. | 473/481 |
| 7,056,242 | B2 * | 6/2006 | Tsinberg | 473/481 |
| 7,713,149 | B2 * | 5/2010 | Docherty | 473/447 |
| D656,200 | S * | 3/2012 | Talbert | D21/302 |
| 8,371,965 | B2 * | 2/2013 | Quinn | 473/487 |
| 2009/0264226 | A1 * | 10/2009 | Mauro | 473/488 |

OTHER PUBLICATIONS

Peter J. Brancazio, "Physics of Basketball"; Am. J. Phys. 49(4), Apr. 1981; pp. 356-365. Apr. 1, 1981.
Larry M. Silverberg; Chau M. Tran; Taylor M. Adams; "Optimal Targets for the Bank Shot in Men's Basketball"; Journal of Quantitative Analysis in Sports; vol. 7, Issue 1, Article 3 Jan. 1, 2011.

* cited by examiner

*Primary Examiner* — Mitra Aryanpour
(74) *Attorney, Agent, or Firm* — Middleton Reutlinger

(57) ABSTRACT

A device and method pertaining to a basketball shooting aiming aid, which is positioned at a rear side of a transparent basketball goal apparatus and provides a rear target at which a shooter may aim when shooting a bank shot, which target is independent of the shooter's position on the court at the moment of shooting. A minimum impingement height line is also provided so that when a basketball impinges the backboard above this line and along a line toward the rear target, the basketball will reflect downwardly at an angle of at least 32 degrees, increasing the chance of moving through the rim.

20 Claims, 23 Drawing Sheets

8/23

AIMING AID FOR BASKETBALL BANK SHOT AND METHOD OF USE THEREOF

CROSS-REFERENCE TO RELATED DOCUMENTS

This is a Continuation-in-part application claiming priority to U.S. patent application Ser. No. 13/175,008, filed Jul. 1, 2011 which is incorporated by reference herein.

TECHNICAL FIELD

This device pertains to a basketball shooting aiming aid and a method of use. More particularly, the device pertains to a basketball shooting aiming aid, which is positioned at a rear side of a transparent basketball goal apparatus and provides a single target at which a shooter may aim when shooting a bank shot, which target is independent of the shooter's position on the court at the moment of shooting.

BACKGROUND

Organized basketball play is governed by rulemaking bodies, for example the National Collegiate Athletics Association (NCAA) and the National Basketball Association (NBA). These bodies establish not only rules for the game itself but also dimensional standards for equipment utilized in organized games governed by these respective bodies.

A basketball goal includes a basketball ring, also known as a "rim," through which the basketball is shot in order to score one or more points, such rim being attached by a mounting assembly along a front surface of a rigid backboard, extending perpendicularly from the front surface thereof and parallel to the basketball court surface, against which backboard the basketball may bounce before passing through the rim for a score. When the basketball is shot first against the backboard in order to bounce into and through the rim, such shot is known as a bank shot.

Geometric relationships between components of an exemplary basketball goal and related equipment are explained for ease of understanding. By way of example, a typical basketball rim has an inside diameter of eighteen inches (18"). The attached rim is equidistant from the sides of the backboard, and is located ten feet above the basketball court, although such height may be adjusted for various age groups. The rim has a center point which is centered relative to vertical side edges of the backboard and is on a line perpendicular to the surface of the backboard. This line may be referred to as the centerline of the front rim. The center point of the rim is positioned fifteen inches (15") from the front surface of the backboard, and the inside edge of the rim is spaced by the mounting assembly and the width of the rim itself to be six inches (6") from the front surface of the backboard. A regulation-size basketball configured in accordance with typical equipment rules is generally spherical and has a diameter of about between nine inches (9"), and nine and one-half inches (9.5"), thus the inside diameter of the typical basketball rim is nearly twice the diameter of a regulation size basketball. Because of the relative difference between the inside diameter of the rim and the diameter of the basketball, when a shooter shoots a basketball, be it a direct shot through the rim or a bank shot, the shooter has margin for error, i.e., the inside diameter of the rim target is almost twice the diameter of the basketball which, must pass through it for a score. Thus, depending on the actual diameter of the ball, there is about 4.5" of margin between the surface ball and the rim when the ball is passing through the rim at the rim center point.

Many basketball goals, regardless of sanctioning body, utilize transparent basketball backboards. Whether the backboard is transparent or not, the basketball backboard includes a painted or adhered square on the backboard behind, perpendicular to the plane of and above, the rim placed there as an aiming aid for the shooter of the basketball. Also, each rim has a mesh net depending therefrom, generally 15 to 18 inches in length, (the rim and net in combination generally being known as a "basket"), the net serving, among other things, to provide the shooter of the basketball a depth perception of rim location as well as to aid the shooter to visualize the center point of the rim which is the ideal aiming point for the direct shot, though there is margin for error.

As mentioned, bank shots are those which are shot against the backboard, to be bounced off of it before passing through the rim for a score. Bank shots are difficult to learn and to execute for some shooters because of the multiple angles of reflection which such shooters must recognize and because, heretofore, bank shot aiming has effectively required shooters to aim at varying aiming points on a backboard, including varying aiming points relative to the square on the backboard, and varying aiming points relative to the rim. With regard to the prior art and as previously described, the aiming point on the backboard varies for each bank shot, as opposed to a single ideal aiming point for a direct shot through the rim, because the bank shot aiming point on the backboard is dependent at least upon the player's location on the basketball court, at the moment of the shot, relative to the basketball goal. Stated otherwise, when shooting a basketball at a backboard for a bank shot, depending on where the shooter is located at the moment of the shot, heretofore the shooter of an intended bank shot would need to determine the appropriate aiming point on the backboard itself for any given bank shot attempted, which aiming point would be different from a multiple of other bank shot aiming points.

Because of the margin for error allowed by the relative size of the rim to the basketball, there can be some margin for error in the bank shot aiming point, and the close-in or "inside" bank shot, that is when the shooter is within a few feet of the basket, is therefore easier to execute than an outside bank shot (that is, when the shooter is more than a few feet from the basket). Nevertheless, when using the backboard as the general target for a bank shot, there are numerous and varying aiming points for a shooter to aim at when shooting a bank shot, all of which are dependent on the shooter's position. As a result, this bank shot aiming determination can be extremely difficult at game speed. Many basketball shooters therefore have come to prefer the direct basketball shot, particularly when shooting an outside shot, because, as compared to taking the bank shot, the shooter of the direct shot needs only to aim at the center point of the rim, which aiming point is always independent of the shooter's location or motion at the time of the shot. Everywhere the shooter of the direct shot goes on the basketball court, there remains only one ideal target for the shot, i.e., the center of the rim.

Thus, generally the known art for aiming a basketball bank shot heretofore required that a shooter learn to aim at varying points on a basketball backboard depending on, among other things, the shooter's location on the basketball court. It would be desirable to overcome these and other difficulties for effectively aiming a basketball bank shot by providing an apparatus and method for a shooter shooting a basketball bank shot to be able to aim at a single target, independent of the shooter's location at the moment of the shot which, when accurately utilized, would result in the increased likelihood of the basketball bank shot deflecting off of the backboard and passing through the rim for a score.

SUMMARY

According to some aspects, an aiming aid for shooting basketball bank shots comprises a transparent backboard having a front surface, a rear surface and a thickness, a first circular rim extending from the front surface of the backboard in a horizontal plane perpendicular to the backboard, the first circular rim having a center point positioned on a centerline extending perpendicularly through the backboard, the center point positioned a first distance from the front surface of the backboard, and, a single target spaced rearwardly from the rear surface of the backboard, the single target having a point positioned a second distance from the front surface of the backboard, the point positioned within a vertical plane, the vertical plane encompassing the centerline. The aiming aid wherein the second distance is generally equal to the first distance. The aiming aid wherein the single target further comprises a mounting bracket. The aiming aid wherein the mounting bracket is adjustable at least one of vertically or horizontally. The aiming aid further comprising said single target being aligned with the first circular rim in a direction which is perpendicular to the front of said backboard. The aiming aid wherein the single target is bolted to the backboard. The aiming aid wherein the single target is attached to the backboard with an adhesive. The aiming aid wherein the single target is removably connected directly or indirectly to the backboard. The aiming aid wherein the single target is illuminated. The aiming aid further wherein the point of the single target is at a different elevation than the first circular rim. The aiming aid further comprising at least one luminaire adjacent to one of an elevated or a lowered center point relative to the first circular rim. The aiming aid wherein the single target is a colored structure. The aiming aid further comprising support structure which supports at least one of the backboard and the single target. The aiming aid wherein the single target has at least one component which is connected to a support structure.

According to some other aspects, an aiming aid for shooting basketball bank shots comprises a first circular rim connected to a backboard for shooting basketball, having a first center point, a rear target disposed on a side of the backboard opposite the first circular rim, the rear target having a second point, the first center point of the first rim disposed a first distance from a front surface of the backboard, the second point of the rear target disposed a second distance from a rear surface of the backboard, in a direction of a center line perpendicular to a front surface of the backboard, the center line extending between the first rim and the second rim, the second point disposed within a plane also containing the center line, wherein the second point is at least about six inches (6") from the front surface of the backboard. The aiming aid wherein the rear target is a second rim, the first rim and the second rim are of different diameter. The aiming aid wherein the rear target is a second rim, the first rim and the second rim are the same diameter. The aiming aid wherein the second distance is equal to the first distance less a thickness of the backboard. The aiming aid wherein the rear target is illuminated. The aiming aid wherein the rear target is at a substantially equivalent elevation as the first rim. The aiming aid wherein the rear target is connected to the backboard one of either directly or indirectly. The aiming aid wherein the rear target is connected to support structure of one of a building or the backboard. The aiming aid wherein the second point is a center point of the rear target. The aiming aid wherein the second point is about fifteen inches (15") from the front surface of the backboard.

According to still other aspects, an aiming aid for shooting basketball bank shots comprises a transparent basketball backboard, a front rim extending toward a basketball playing area, a target positioned behind a rear surface of the backboard, the target being a first distance from a front surface of the backboard which is equal to a second distance from the front surface of the backboard to a point within a circumference of the front rim, the target being positioned one of along, above, or below a centerline extending from the front rim through the backboard and toward the target, wherein the target is independent of the shooter's position at which to aim when shooting a bank shot. The aiming aid wherein the target is a rim. The aiming aid further comprising a net depending from the rim. The aiming aid wherein the rim is circular. The aiming aid wherein the rim is non-circular. The aiming aid wherein the target includes a luminaire. The aiming aid wherein the target is at least one of illuminated or painted. The aiming aid wherein the target includes a semi-spherically shaped portion. The aiming aid wherein the target includes a surface angled relative a plane of the front rim. The aiming aid wherein the target extends above an elevation of the front rim. The aiming aid wherein the target depends below an elevation of the front rim. The aiming aid wherein the point is a center point of the front rim. The aiming aid wherein the target is connected to a structural member supporting one of the backboard or a building wherein the backboard is located. The aiming aid wherein the target includes at least one of a scoop or a fin. The aiming aid wherein the point of the target is about fifteen inches (15") from a front surface of the backboard.

According to some other aspects, a method of installing an aiming aid for basketball bank shots comprises positioning a target behind a transparent basketball backboard, a point of the target being aligned with a front rim in a direction perpendicular to a plane of the backboard, the point of the target being at least six inches (6") from a front surface of the backboard. The method wherein the positioning is by a bolted connection. The method wherein the positioning is by an adhesive. The method further comprising illuminating the target. The method wherein the positioning of the target is at a plane that is on a same plane as the front circular rim. The method of aiming basketball bank shots wherein the plane is different than the front circular rim. The method wherein the point is a center point. The method wherein the target has a central axis. The method wherein the target includes a point which is about fifteen inches (15") from a front surface of the backboard.

According to some further aspects, a method of aiming basketball bank shots comprises aiming a basketball at a target on the rear side of the backboard, the target being a first distance from a front surface of the backboard and aligned with a center of the front rim in a direction perpendicular to the front surface of the front rim, shooting a basketball solely at the target on the rear side of the backboard, banking the basketball off of a front surface of the backboard and through a front circular rim. The method of aiming basketball bank shots wherein the basketball has a flight path. The method of aiming basketball bank shots wherein the flight path on the rear side of the backboard extends through the target. The method further comprises teaching a shot wherein the shot travels one of upward or downward at the target and ricochets off of the backboard. The method wherein the basketball has an intended flight path on said rear side of the backboard, the intended flight path passing through a center point of the target.

According to still further aspects, a method of instruction for an aiming aid for basketball bank shots comprises teaching a shooter to aim solely at a rear target behind a backboard, the rear target being aligned with a front rim in a direction perpendicular to a front surface of the backboard, teaching a shooter to bank the basketball off of a front surface of the backboard and through a front rim. The method further comprising connecting the rear target to the backboard. The method wherein the connecting being a bolted connection. The method wherein the connecting is by an adhesive. The method wherein the connecting is by supporting from a backboard support structure. The method wherein the connecting is by magnetic force. The method further comprising positioning the target at a distance from a location on or within the front rim. The method wherein the distance is greater than a distance from the front surface of the backboard to a position on the front rim. The method wherein the position on the front rim is a similar position defining the distance at the rear target rim.

According to some other aspects, an aiming aid for shooting basketball bank shots, comprises a transparent backboard having a front surface, a rear surface and a thickness, a first circular rim extending from the front surface of the backboard in a horizontal plane perpendicular to the backboard. The first circular rim has a center point positioned on a centerline extending perpendicularly through the backboard, the center point positioned a first distance from the front surface of the backboard. A target is spaced rearwardly from the rear surface of the backboard, the target having a point positioned a second distance from the front surface of the backboard, the point positioned within a vertical plane, the vertical plane encompassing the centerline. A removable overlay is positioned on one of the front surface and the rear surface of the backboard, the overlay having one of a minimum height line or a mark-through opening corresponding to the minimum height line, the minimum height line being defined by a plurality of radial projections extending from tangent points of the first circular rim, the projections being projected at an angle of at least 32 degrees from the tangent points of a rearward side of the first circular rim closer to the backboard. The target and the minimum height line disposed such that when a basketball impinges the backboard at a point above the minimum height line and on a line through the target, the basketball will reflect through the first circular rim.

Optionally, the mark-through opening of the overlay being removable when the minimum height line may be formed on the backboard. The overlay may be removably adhered to the backboard. The overlay may be removed when the minimum height impingement line is formed on the backboard. The overlay may be a decal. The overlay may be supported along a bottom edge. The overlay may be adhered to either of the front surface or the rear surface of the backboard. The opening may define a stencil for forming a line on said backboard. The angle is between about 32 degrees and about 90 degrees. The minimum height impingement line may be curvilinear. The minimum height impingement line is formed of linear segments. The minimum height line may be generally V-shaped.

According to some aspects, an aiming aid for shooting basketball bank shots comprises a transparent basketball backboard, a front rim extending toward a basketball playing area, a target positioned behind a rear surface of the backboard. The target is a first distance from a front surface of the backboard which is substantially equal to a second distance from the front surface of the backboard to a point within a circumference of the front rim. The target is positioned one of along, above, or below a centerline extending from the front rim through the backboard and toward the target. The target is independent of the shooter's position at which to aim when shooting a bank shot. An overlay is positioned on one of the front surface and the rear surface of the backboard, the overlay has a minimum impingement height line, the minimum impingement height line is defined by a plurality of radial projections extending from a rearward periphery of the first circular rim toward the backboard. The projections are projected at an angle of at least 32 degrees from the rearward periphery of the first circular rim. The target and the minimum impingement height line are disposed such that when a basketball impinges the backboard at a point above the minimum height line and along on a line through the target, the basketball will bounce through the first circular rim.

According to some other aspects, an aiming aid for shooting basketball bank shots comprises a first circular rim connected to a backboard for shooting basketball, the first circular rim has a first center point, a rear target disposed on a side of the backboard opposite the first circular rim, the rear target has a second point. The first center point of the first rim is disposed a first distance from a front surface of the backboard. The second point of the rear target is disposed a second distance from a rear surface of the backboard, in a direction of a center line perpendicular to a front surface of the backboard. The center line extends between the first rim and the second point, the second point disposed within a plane also containing the center line. An overlay for positioning against the backboard includes a minimum impingement height line thereon for banking a basketball against the backboard. The minimum impingement height line defined by a plurality of projections extends rearwardly from the first circular rim toward the backboard at an angle of at least about 32 degrees. The rear target and the minimum impingement height line arranged relatively such that when a basketball impacts the backboard at a point above the minimum height line and along on a line through the rear target, the basketball will bounce through the first circular rim.

Optionally, the minimum impingement height line may be a line. The line may be curvilinear, arcuate or at least one linear segment. The overlay may be disposed on one of the front surface and the back surface of the backboard. The minimum impingement height line may be a mark through window for forming a corresponding minimum impingement height line on the backboard. The minimum impingement height line may be one of permanent or removable. The overlay being one of permanent or removable.

All of the above outlined features are to be understood as exemplary only and many more features and objectives of the basketball aiming aid may be gleaned from the disclosure herein. Therefore, no limiting interpretation of this summary is to be understood without further reading of the entire specification, claims, and drawings included herewith.

BRIEF DESCRIPTION OF THE ILLUSTRATIONS

The above-mentioned and other features and advantages of these embodiments, and the manner of attaining them, will become more apparent and the embodiments will be better understood by reference to the following description taken in conjunction with the accompanying drawings, wherein.

DETAILED DESCRIPTION

Figure 1:
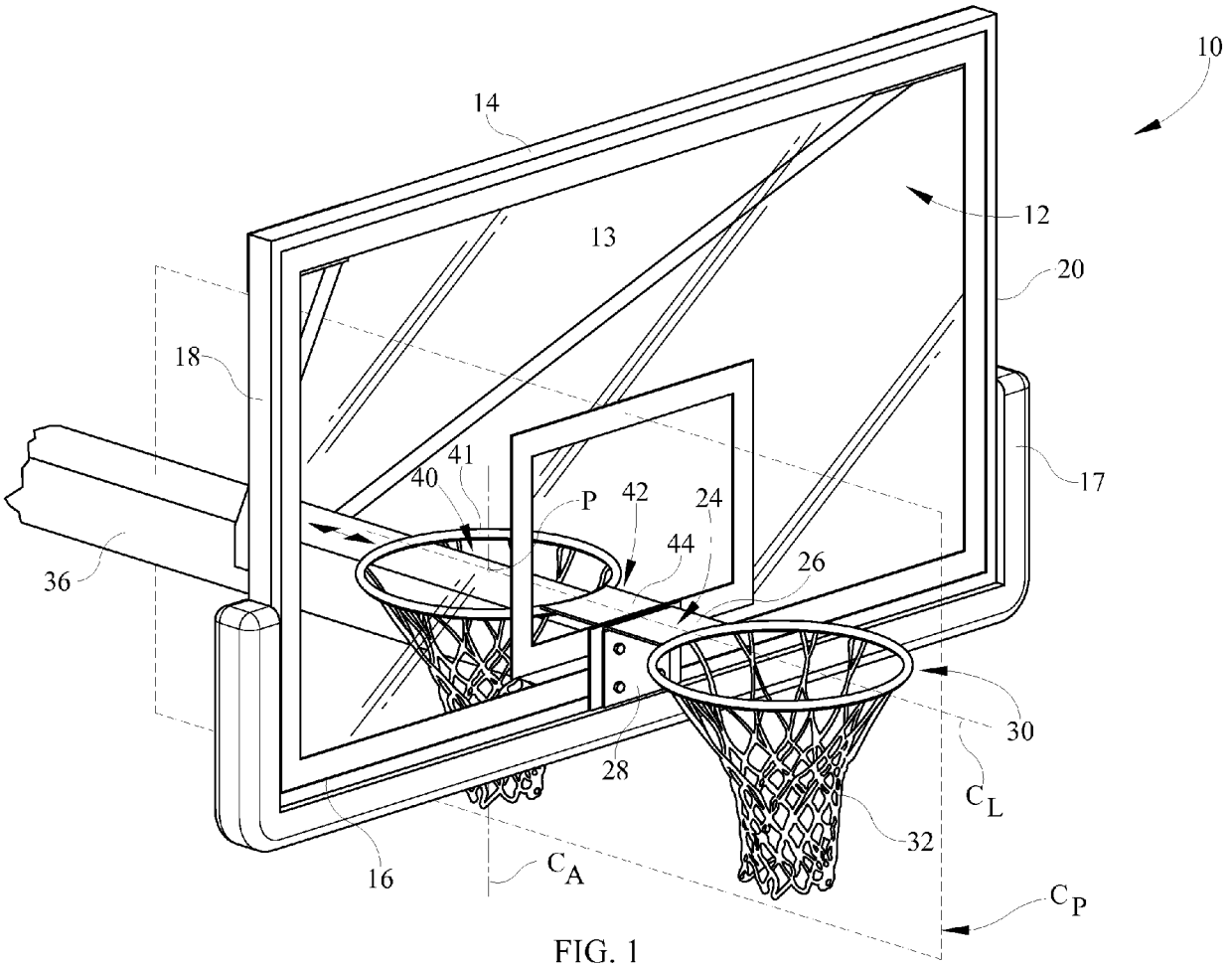
FIG. 1 is a perspective view of an exemplary basketball goal which is utilized with an exemplary aid.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to FIGS. 1-16, various embodiments of an aiming aid for shooting basketball bank shots are shown which provide a shooter a single stationary target at which to aim during the shooting of a bank shot off of a transparent backboard which target is independent of the shooter's location at the time of the bank shot and independent of any aiming point of the backboard itself. The aiming aid or target, which may take a variety of non-limiting forms shown herein, is positioned behind a transparent backboard, and may include, but is not limited to, a centered point, axis or both, within the target structure, for example a rim, post, light, structural member or the like. The centered point or axis of the target provides an aiming location or alignment for a shooter of a bank shot and further provides that the shooter has only a single target location or object to look at or align the bank shot with while shooting a bank shot from any shooting angle greater than zero degrees from a plane of the backboard. The rear target draws the bank shot shooter's aim and shot direction to a single aiming location or reference point, which may include but is not limited to a centered point of such rear structure, wherein the rear target and/or the centered point may preferably, but not necessarily, be aligned with a centered point or line $C_L$ of a front rim in a direction perpendicular to the plane of the backboard, and may also, but not necessarily, be at the same horizontal plane or elevation of the center point of the front rim. Unexpectedly, a single target behind the basketball goal is provided for a shooter of a bank shot which removes the problem of ever-varying backboard aiming points from the shooting of a basketball bank shot.

Referring now to FIG. 1, a perspective view of the aiming aid 10 is depicted. The aiming aid 10 includes a transparent basketball backboard 12, which is generally rectangular in shape, but such shape may vary. Likewise, the size and dimension are not limited, as regulation sizes may differ based on the sanctioning body, for example the National Collegiate Athletic Association (NCAA) for amateur collegiate basketball or the National Basketball Association (NBA) governing professional basketball games. The backboard 12 is formed of a rigid, transparent or otherwise non-opaque material, such as glass, Plexiglas or other materials that are required or deemed appropriate by the relative sanctioning bodies, and the thickness may vary depending on the strength of the material.

The basketball goal is shown generally having a mounting structure 36, a backboard 12 and rim 30. The backboard 12 includes an upper edge 14, a lower edge 16 and left and right side edges 18, 20. These edges may be formed by a frame within which the glass or transparent material 13 is disposed, or may be formed by the transparent material.

Extending from the front surface of the backboard 12 is a bracket assembly 24. The bracket assembly 24 may include one or more fixed or movable pieces, which connect a front rim 30 to the backboard 12. The bracket assembly 24 may be connected directly to the backboard or may be connected to a mounting block or structure if the backboard is of a thickness less than a backboard surrounding frame. For example, a mounting block may be positioned on a rear surface of the backboard 12. In the exemplary embodiment depicted, the bracket assembly 24 includes a spacer 26, which is connected to a mounting bracket 28 and defines an L-shaped assembly. The spacer 26 may be integrally formed with the front rim 30 or connected thereto by various means, such as welding. The spacer 26 is dimensionally limited by the rules set forth by various sanctioning bodies. For example, according to the NCAA, the distance between the front surface of the backboard 12 and the inside edge of the rim 30 should be six inches, as previously described. However, this dimension may vary depending upon the rules under which the basketball goal is governed. The rim 30 is circular in shape and may have an inside diameter of eighteen inches (18"), according to one exemplary set of rules. The center point of the rim 30 may be 15 inches (15") from the front surface of the backboard 12. Further, for example, the rim 30 itself may be circular in cross-section with a cross-sectional diameter of less than or equal to five-eighths (⅝") of an inch, for example. Although this dimension is set forth, the rim 30 may have various cross-sectional shapes and therefore should not be limited to a circular cross-section. Depending from the front rim 30 is a net 32 which will be understood by those skilled in the art to slow the descent of the basketball following a made basket and aiding in dropping the basketball directly beneath the basketball goal. Additionally, the net 32 aids the shooter in visualizing the center point of the rim 30 and aids with a shooter's depth perception of the location of the rim when shooting. As will be understood, by shooting at the center point of rim 30, the shooter has some margin for error due to the size relationship between the basketball and the diameter of the rim 30. However, any basketball shot on an arcuate path which intersects with said center point of rim 30 (without first touching the rim in a way adversely affecting the shot) will result in a score.

Also shown through the transparent backboard 12 is a rear target 40, for example a rim 41. The rear target 40 is depicted as circular in shape, and as having roughly the same size as front rim 30, although various structural shapes, materials, sizes and embodiments may be utilized for the target all of which may be mounted to the backboard 12, rim 30, structural mounting components or other to the basketball goal. For example, metals, wood, plastics or other materials may be used for the rear target 40, any of which may be connected as shown mechanically, such as bolted, or by other permanent or removable manners, such as by adhesives or magnets for example, and directly or indirectly to the backboard 12, the structural components, or otherwise to the basketball goal. The target 40 is visible through the backboard 12 so that the shooter of a bank shot may visualize an aiming point during the bank shot which is independent of his position and motion on the court and may shoot the basketball bank shot at a single target. In this manner, the shooter of the bank shot learns the aiming point for the bank shot independent of the shooter's position. The rear target 40 may be in the same plane as the upper edge of the rim 30 and has a center point which is aligned with the center point of rim 30 in a direction perpendicular to the plane of the backboard 12. The rear target 40 of the exemplary embodiment may optionally include a net, or other downwardly depending or upwardly extending structure to aid the shooter in visualizing target 40. The net is shown cut to accommodate the structure 36 but alternatively may be formed in two pieces, if the goal support structure 36 needs to be accommodated for.

Figure 3:
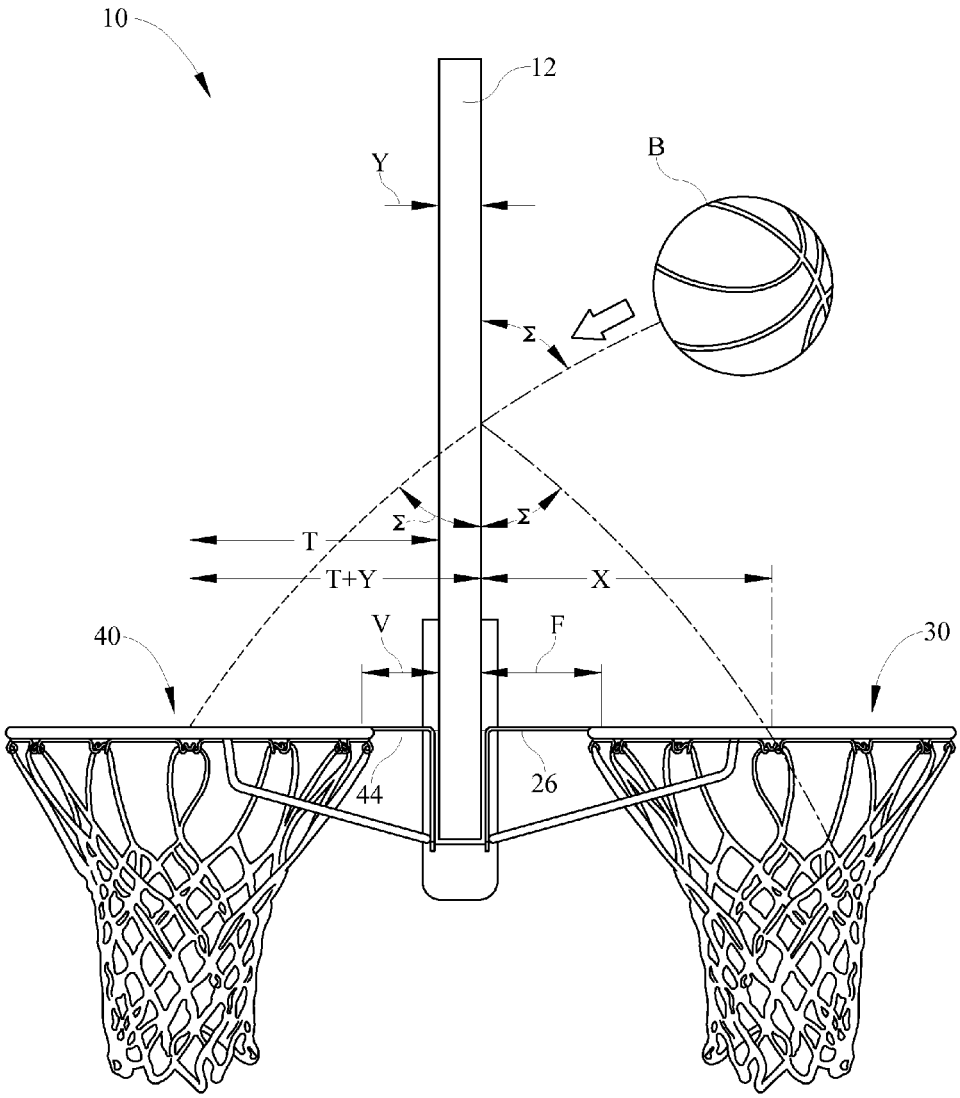
FIG. 3 is a side view of the exemplary basketball goal depicting a basketball flight path and a bank line flight path of the basketball.

Referring still to FIG. 1, the basketball approaches the backboard 12 at a first angle relative to the backboard and deflects from the backboard 12 at nearly the same angle. By accurately shooting at this rear target 40, and due to the known angles of reflection, the basketball will bank or ricochet off of the backboard 12 and pass through the front rim 30. It will be understood that the reflective angles for such bank shot are measured relative to two axes, a vertical axis of the backboard 12 and a horizontal axis of the backboard 12. If the bank shot is taken from a position perpendicular to the backboard 12 on the centerline of the rim, one angle of the shooting angle is ninety (90) degrees relative to the horizontal axis of the backboard, but the other angle relative to the vertical axis may still be measured, as shown in FIG. 3.

The rear target 40 of at least one embodiment also has the circular shape of the front rim 30 for ease of visualization by the shooter and further may be formed of various cross-sectional shapes. The use of a circular rim 41 for the rear target 40 provides what appears to be a minor reflection of the front rim 30 which in turn provides an accurate aiming line or image for the shooter. A net or other device may depend from the rim 41, and the net could be formed around a structural component such as mounting structure 36 (FIG. 1). Alternatively structures may be formed to extend upwardly above the plane of the target 40. According to the instant embodiment, the target 40 has a circular cross-section like the front rim 30. The rear target 40 is connected to the backboard by a bracket assembly 42 including a spacer 44. The spacer 44 may have a fixed length or may have a variable or adjustable length spacer (FIG. 4) so that such spacing of the rear target 40 is adjustable relative to the front surface of the backboard 12. A double-headed arrow is shown adjacent the rear target 40 to indicate that the spacing of the target 40 relative to the front surface of the backboard 12 may be varied. The goal of such structure is to provide that the centered point or ideal aiming point P of the target 40 is positioned an equal distance from the front surface of the backboard as the center point of the front rim 30 wherein the centers or aiming points are aligned on a center-line $C_L$ or in a center plane $C_P$ in a direction perpendicular to the surface of the backboard 12.

As one skilled in the art will understand with review of this and further embodiments, each rear target described may have a centered point P encompassed by center line $C_L$, center axis of the rear target $C_A$, or centered plane $C_P$. A center line $C_L$ or centered plane $C_P$ pass from the center of front rim 30 in a direction perpendicular to the backboard 12 through the centered point P and/or axis $C_A$ of the rear target, 40 according to this exemplary embodiment. A plane $C_P$ is shown in broken line extending vertically in one direction and perpendicularly through the backboard 12 in a second direction. The plane $C_P$ contains both the center line $C_L$ and the point P or the axis $C_A$. The point P may be positioned along the center line $C_L$ or above or below it but is aligned with the center of the front rim 30 encompassed by the pane $C_P$. This concept of positioning of the rear target relative to the front rim 30 and backboard 12 carries throughout the various embodiments shown and described herein. The rear targets, as described throughout this description, may also include the centered point P.

Figure 2:
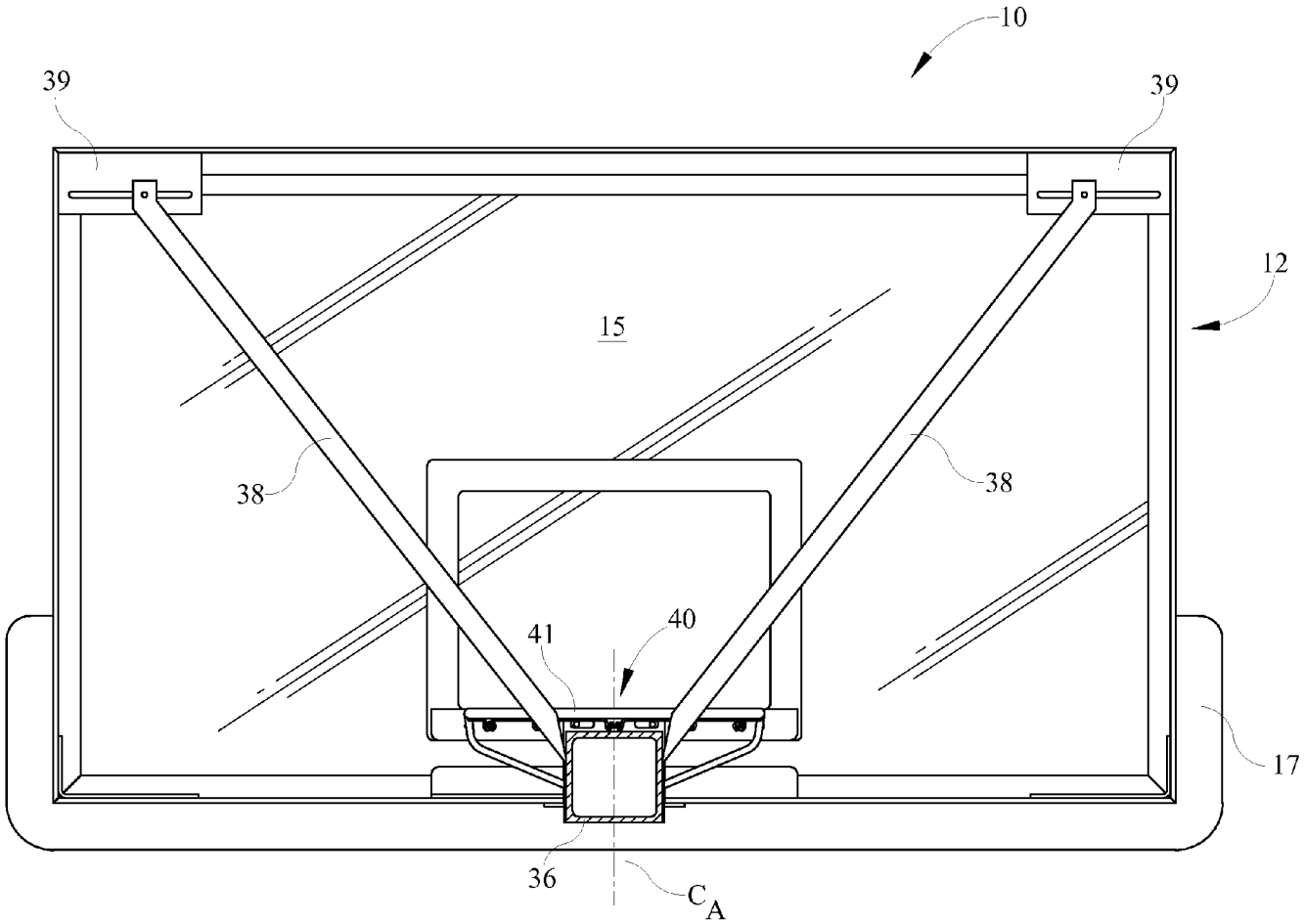
FIG. 2 is a rear view of the exemplary basketball goal of FIG. 1.

Referring now to FIG. 2, a rear view of the backboard 12 is depicted. The rear surface of the backboard 15 is shown. The rear view also shows more clearly at least one exemplary structure for mounting a backboard 12. In this depiction, a mounting beam 36 extends from the rear of the backboard 12 and may need to be accounted for in the design of the target if, for example the upper surface of beam 36 extends above the upper plane of rim 30. According to at least one embodiment, it may be desirable to position the target or one or more portions of the target at the same elevation or same horizontal plane as the front rim 30. The mounting beam 36 may be connected to the backboard at various locations and by various means. According to the exemplary embodiment, the support beam 36 connects to the first and second struts 38. These struts 38 extend from the support beam 36 toward upper corners of the backboard 12 at respective connection brackets 39. A solid welded connection, bolted connection or other engagement structure may connect the brackets 39 to the struts 38. Likewise, the support beam 36 may be connected to the struts' lower ends in various fashions and means. As an alternative, the rear target 40 may be positioned to be supported by the support structure such as the beam 36, or struts 38 or 39 in a variety of ways. Moreover, the support beam 36 may include, but not necessarily, posts extending from floor level or depending from building structures as well as folding or rotating truss or scaffolding structures which extend from floor level or depending from building structure. The rear target 40 or any of the embodiments shown herein may be connected to these alternative structures.

According to the instant embodiment, the target 40 is positioned above the support beam 36 so that it is clear of the upper surface of the beam 36 while still positioned at the same plane of the front rim 30. If the beam 36 is of a size that forces the target 40 to be placed above or outside of the upper plane of the rim 30, the shape of the rim 41 may be varied so as to compensate for the location of the support structure and to locate the plane of the target 40 closer to the plane of rim 30. As described further herein, the center point $C_P$ or center axis $C_A$ of the target 40 has a spacial relationship to the front surface of the backboard 12 and the center point of the front rim 30. As previously mentioned, alternative structures may be utilized for the target 40 beyond the exemplary target rim 41 depicted. These alternative target structures should be positioned keeping such relationship in mind. Additionally, such alternative target may be positioned on the support beam 36 in addition to or alternative to the connection to the backboard 12, rim 30, or bracket assembly 24 (FIG. 1).

Referring now to FIG. 3, a side view of the aiming aid 10 is depicted. In this view, the flight path line of the basketball B is shown before and after banking from the backboard 12 during a bank shot. The angle is measured between the incoming flight path of the basketball and a vertical axis along the plane of the front surface backboard 12. At the time of the bank or deflection from the backboard 12, or immediately thereafter, the substantially same angle Σ is formed between the front surface of basketball backboard (along a vertical axis) and the deflected flight path of the basketball. The angle Σ is also formed between the intended flight path to the rear target 40 and the front surface of the backboard 12 as well. The intended flight path or target line of the basketball toward the rear target 40 is also shown as if it would not be interrupted and deflected by the rigid surface of backboard 12. The backboard 12 is shown with a front rim 30 and a rear target 40 extending in the same plane as rim 30 from front and rear surfaces of the backboard 12, respectively. The Figure is labeled with various dimensions to aid in understanding the use of the target 40. From the front surface of the backboard 12 perpendicularly to the center point of the rim 30 is a first distance X. This distance X is generally fixed by the rules of the governing basketball body sanctioning the equipment dimensions. For example, the distance X, according to the NCAA, should be equal to fifteen inches (15"). The exemplary measurement is horizontal although the measurement may vary as long as the method of measuring is consistent in the front and rear of the backboard. The first distance X is equal to a second labeled dimension T+Y, wherein T equals a distance from the center or aiming point of rear target 40 to the rear surface of the backboard 12, inclusive of any rear-side structural mounting components integral to the rear side of the backboard, such as brackets, if any, and Y is equal to the thickness of the backboard 12. The figure also includes a fixed distance F which is the distance from the front surface of the backboard 12 to the inside edge of the rim 30. This distance F is generally fixed by the rules of the governing basketball body sanctioning the equipment dimensions. For example, the distance F, according to the NCAA, should be equal to six inches (6"). The aiming aid 10 operates when the aiming point of target 40, in this instance its center point, which is visualized by the shooter, is the same distance from the front surface of the backboard 12, in the same plane and aligned through the backboard 12 with center point or center line of the rim 30. In the exemplary embodiment depicted, the basketball B is shown traveling through an arc shaped shooting path, which path (though not the ball) passes through the backboard 12 and through the aiming point of the exemplary target 40, for example rim. However, due to the rigid surface of the backboard 12, the basketball B banks, reflects or ricochets from the front surface and through the front rim 30. Thus, with the aid of this device or aid 10, the shooter visualizes and learns to aim the basketball at a path passing into, through or intersecting on a downwardly arcuate path the aiming point of rear target 40 in order accurately to bank the basketball B through the front rim 30. The rear spacer 44 is labeled with a dimension V as this dimension may vary and, as previously described, may additionally be adjustable depending upon the structure utilized, to compensate for various backboard thicknesses Y, including any rear-side structural mounting components integral to the rear side of the backboard, such as brackets, if any. Additionally, vertical slots maybe provided to adjust the height of the target 40 relative to the height of the front rim 30.

According to at least one embodiment, a dimensional relationship F>V is established in order to compensate for the thickness Y of the backboard 12 and for any other structural component which may be positioned between the rear of backboard 12 and spacer 44. Such structural relationship may be accomplished by shortening the spacer 44 or by providing an adjustment feature such as a slidable spacer assembly (FIG. 4) to correctly position the aiming point P (FIG. 1) of the target 40 at a distance that corresponds to the center point of the front rim 30 measurement X, when both are measured from the front surface of the backboard 12. This relationship is expressed mathematically as the spacer length V being equal to the front rim spacer F less the thickness of the backboard Y (V=F−Y) inclusive of any rear side bracket. Thus, the spacer 44 may be a shorter length than the spacer 26. However, as previously indicated, the spacer 44 may be variable in length.

Also as previously mentioned, any shot may have a certain amount of margin for error. That is, if a flight path of a shot does not intersect with the center point of rear target 40, it may still intersect with some point inside the, for example, target rim 41. If the flight path is within a certain distance of the center point of the target 40 that is, the margin for error, the basketball B may still travel through the front rim 30 after banking from the backboard 12. However, the margin for error may decrease with, for instance, longer distance shots, shots with flatter flight paths, shots with varying angles to the backboard and shots with higher velocity.

Figure 4:
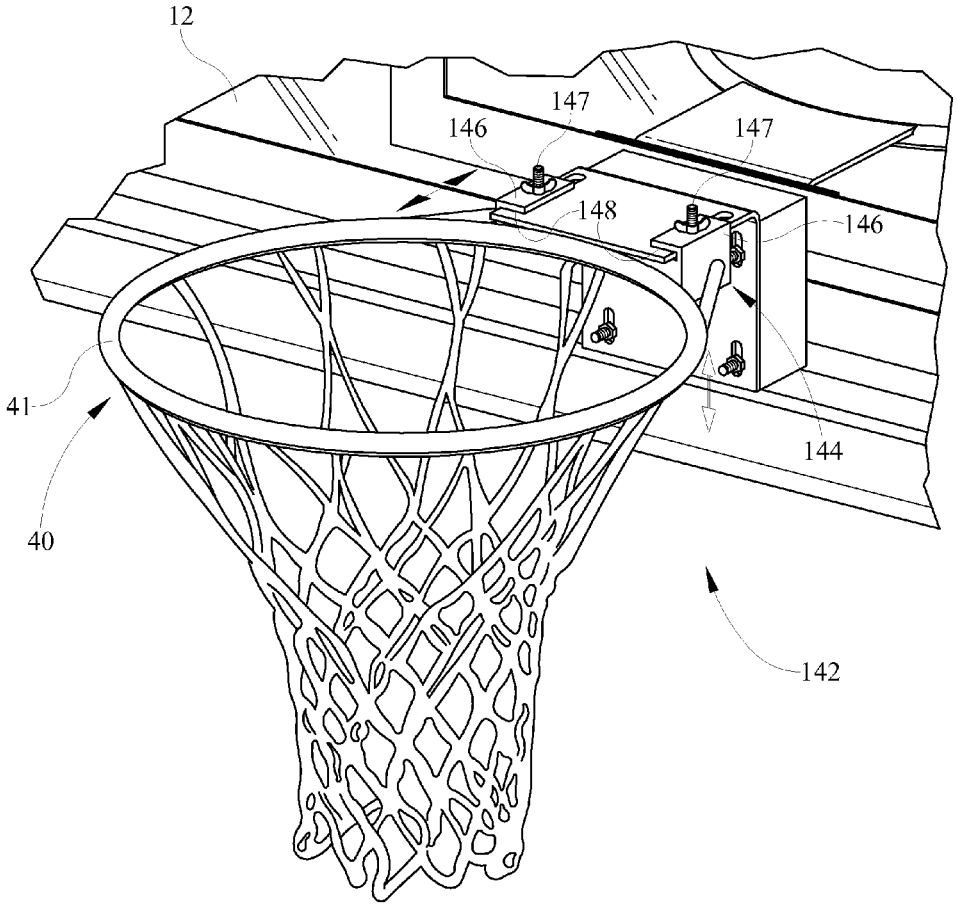
FIG. 4 is a perspective view of an adjustable rear target.

Referring now to FIG. 4, a perspective view of an embodiment of the rear target 40 is depicted with an adjustable bracket assembly 142. As shown generally in FIG. 1, the rear target 40 may be adjustable horizontally toward or away from the backboard 12 in order to provide that the center or aiming point of rear target 40 is the same distance from the front surface of backboard 12 as the center or aiming point of the front rim 30. According to the embodiment depicted, the spacer 144 uses connection structures 146 which are connected to spacer 144 by way of fastener assemblies 147 and slots 148. The slots 148 extend toward or away from the backboard 12. The target 40, for example rim 41, is connected to the connection structures 146 for movement horizontally toward or away from the backboard 12. Accordingly, the target 40 may be adjusted so that the center or aiming point of target 40 and the center of rim 30 are at the same distance from the front surface of the backboard 12. Optionally, the lower vertical portion of spacer 144 may include slots or other structure to allow vertical adjustability of the spacer and 144 and target 40. Further optionally, the target 40, at the spacer 144 allow for adjustment horizontally in a directional parallel to the backboard 12. Such horizontal and vertical adjustability may be utilized with any of the embodiments herein. Various alternative structures may be used to provide such adjustability.

Figure 5:
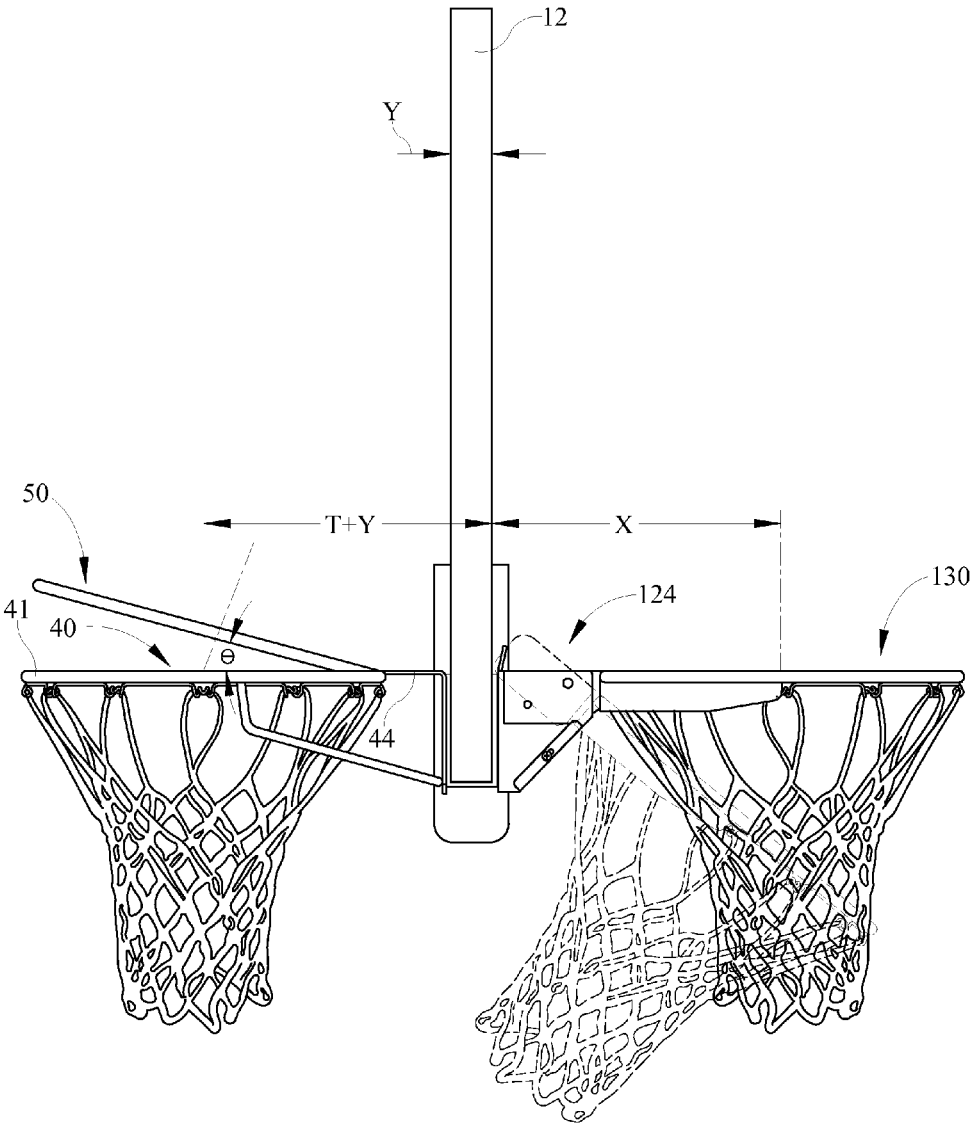
FIG. 5 is a side view of an alternative basketball rim which may be utilized and an alternative rear target embodiment.

Referring now to FIG. 5, a side view is shown having two alternatives for two differing structures. First, an alternate embodiment is depicted wherein a front rim 130 is of a breakaway variety. The breakaway position is shown in broken line to depict the motion of the rim 130. The rim 130 is connected by a bracket assembly 124 to the backboard 12 which moves between first (solid line) and second (broken line) positions. Such rim 130 allows for measured deflection from a normal position when high forces are applied to the rim such as during a slam-dunk. Thus, a fixed rim 30 (FIG. 1) or a breakaway rim 130 may be utilized as alternative embodiments with the exemplary rear target 40 and should be considered within the scope of the appended claims.

Referring now to the second alternative embodiment of FIG. 5, the rear target 40 is depicted extending from an opposite side of the backboard 12 as the front rim 130. As previously indicated, the target 40 includes a center or aiming point of a rim 41 or other structure wherein the target 40 has a spatial relationship with the center point of the front rim 130 relative to the front surface of the backboard 12. As an alternative, which is depicted in the instant figure, an additional or alternate target 50 may be positioned at a location which is angled upwardly from the spacer 44 to provide an easier visual reference to the center or aiming point of the target 40 for the shooter of the basketball. The target 50 may have a solid surface or may include an aperture or other indicia indicating a visible target. With this target 50 angled upwardly from the spacer 44, the shooter can more easily see the rear target 50 rather than the rear rim 41 previously described, since it is not on a flat plane as target 40. It should be clear that this tilted target 50 may be utilized alone or in addition to the target 40. However, there is a relationship between the center point of the tilted target 50 and the center target 40. As shown in the embodiment, a broken line depicts a projection of the center point of the tilted target 50 passing through or near the center point of the rim 41 through the target 40. The angled broken line is representative of an intended flight path of the basketball B through the target 40. Alternatively however, the tilted target 50 may be connected at various locations other than the spacer 44. As with the other embodiments, the instant embodiment draws the shooter's aim to the center point of the rear target 40 which is generally aligned with the center point of rim 30 and aligned with and in the same plane as center point of rim 30. The raised target 50 is positioned at an angle to the rim 41 by an angle θ. This embodiment of the raised or angled target 50 may be utilized with the breakaway rim 130 or the fixed position rim 30 previously described. With all of these examples, it is assumed that the basketball is shot at proper launch angle and velocity such that it would otherwise pass through the center point of the target 40 (but for backboard 12) which may be determined without undue experimentation. Further, the mounting structure for the basketball goal is not shown and may be any of the mounting structures shown or other structures.

Figure 6:
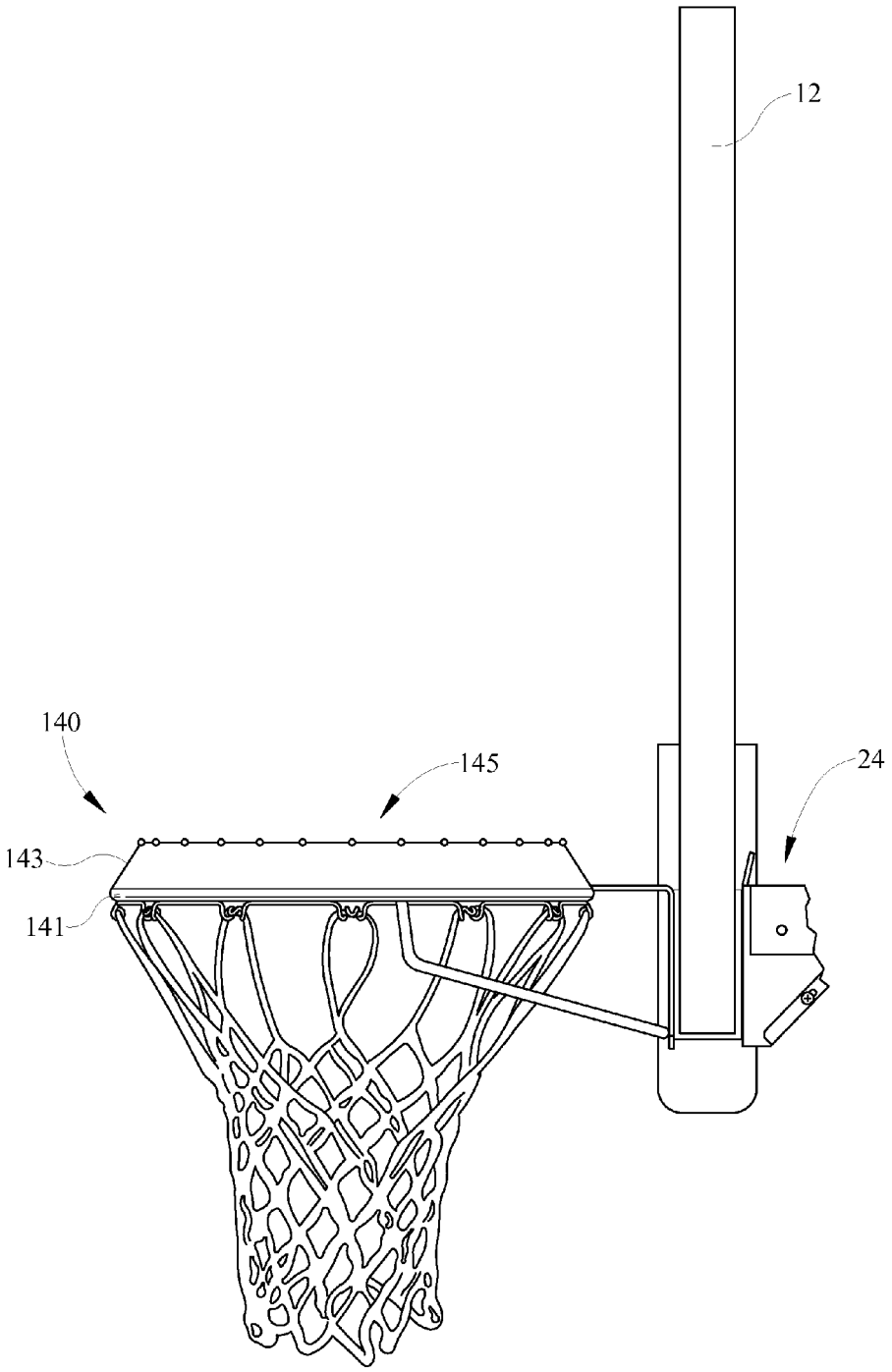
FIG. 6 is a side view of a rear target with an exemplary form of illumination.

Referring now to FIG. 6, a side view of an alternative rear target 140 is shown. The alternative rear target is shown with an exemplary rim 141, but again such shape is not to be considered limiting. Moreover, the target rim 141 is not necessary for implementation of the instant embodiment. The instant embodiment further comprises a raised structure 143 which may occupy the same plane as front rim 30 and/or may be raised above the plane, such as an exemplary frusto-conical structure which has an upper elevation an amount above plane of the front rim 30. The amount by which such structure 143 is raised above target rim 141 should be only so much as aids the shooter of the bank shot to visualize the center point of rear target rim 141 through the backboard 12, but not so much as to cause the shooter to aim away from the centerpoint some distance beyond which is compensated for by the margin for error due to the relationship of the ball diameter to the rim diameter. In order to enhance such visualization, a component such as, for example, a net may depend downwardly, or post, light, structure or combination thereof may depend downwardly or extend upwardly from target rim 141 in conjunction with such raised structure 143. At the upper edge or along an edge of the raised structure 143, an illuminated structure is positioned, although such illumination is not necessary. The illuminated structure 145 may be one or more lights, such as an LED array ring or may take the form of the upper edge or an edge of the raised structure. However, alternative lighting structures may be used. Further, power supplies or drivers may be disposed in various locations. Likewise, the structures used to support the basketball goal may also serve as wireways for power or control wiring for any target illumination.

Figure 7:
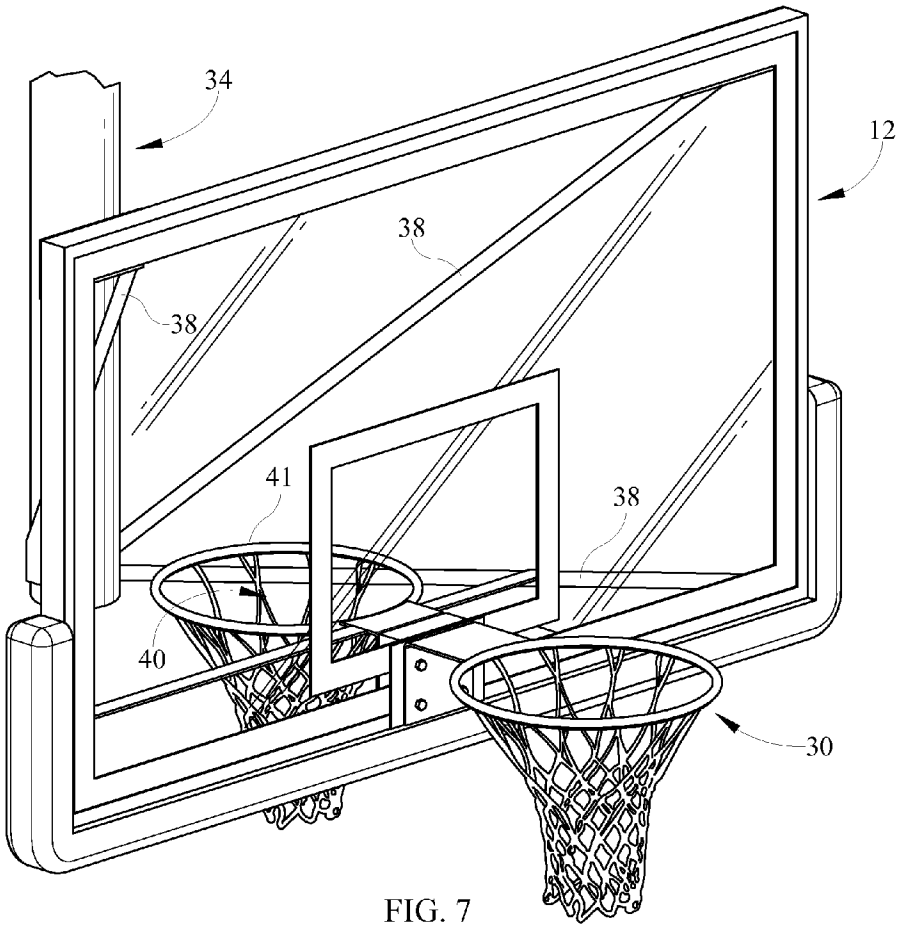
FIG. 7 is a perspective view of a rear target on an alternatively mounted basketball goal.

Referring now to FIG. 7, an alternative mounting structure for the basketball goal is shown in perspective view. The structure includes a vertical pole 34 which may be round, square or other polygonal cross-section. This pole 34 may extend from the ground upwardly, or alternatively may depend from a ceiling of an indoor gym or other truss structure to support the backboard 12 from above. The pole 34 may also pivot to move the basketball goal when the facility is used for other non-sporting events, for example concerts. The mounting structure utilizes struts 38 as previously described which extend from upper corners of the backboard 12 and engage the pole 34 forming a truss to stabilize the backboard 12. Additionally, lower struts 38 are shown to aid in the stabilization of the backboard, as previously mentioned. Various alternative embodiments of structures, shapes and the mounting positions of the struts 38 may be utilized and should be considered within the scope of this and the various other embodiments described herein. These struts 38, pole 34 or other mounting structure may be used to support the target 40 rather than, or in addition to, connections to the backboard 12 for this or any other depicted embodiment. Further, the target 40, for example rim 41, may be substituted with any of the targets and related structures described herein. Further, if the pole 34 or other mounting or support structure should lie within some portion of the target 40 or other targets described herein, said target or support structure may be sectioned, portioned, positioned and/or marked, and may be accompanied by a component such as, for example, a net as shown in FIG. 1, so that the shooter of the bank shot will still be able to visualize the ideal shooting path to the center point of such sectioned, portioned or positioned rear target 40.

Figure 8:
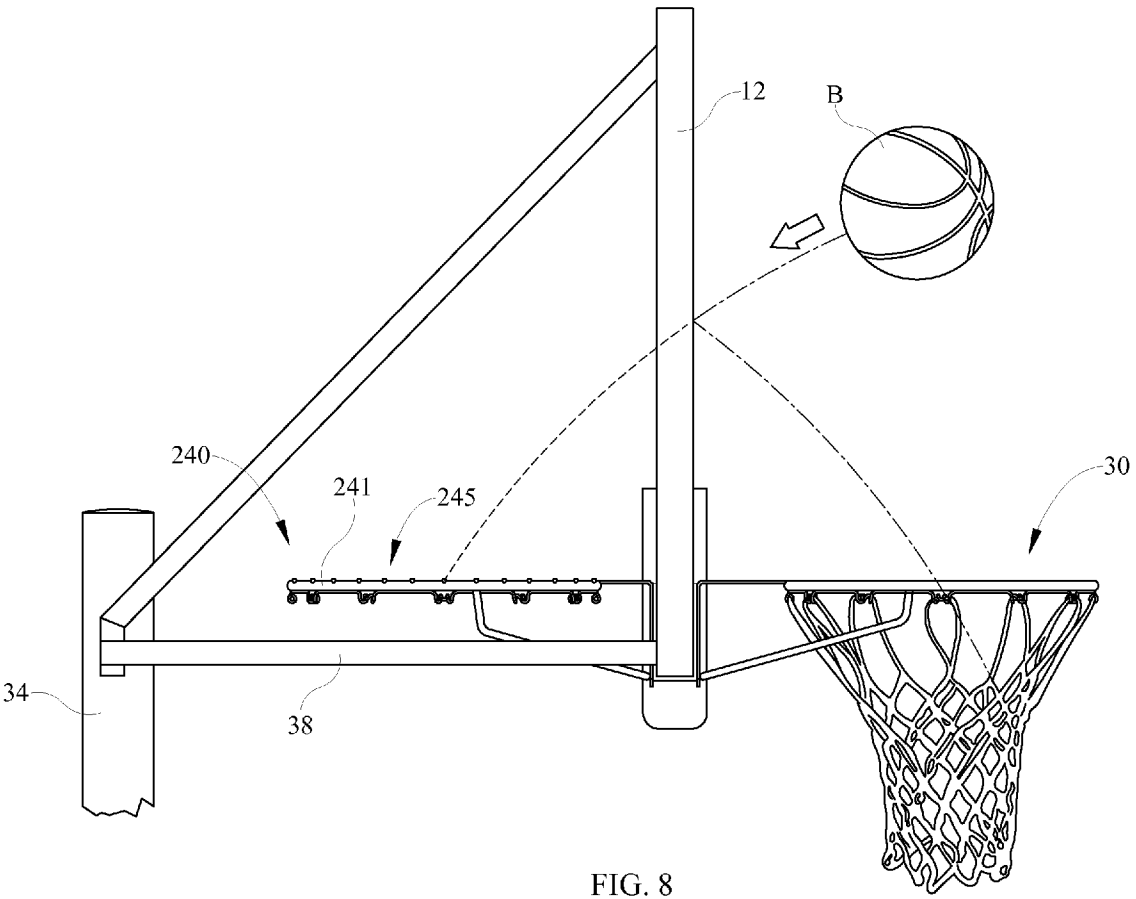
FIG. 8 is a side view of the basketball goal with an alternative rear illuminated target and a basketball with a basketball flight path.

FIG. 8 further comprises a rear target 240 embodied by a rim 241. This target 240 may be illuminated and/or may be colored or any of various means to aid in visualization of the rear target for the shooter. For example, a plurality of LED lights 245 are disposed about the exemplary rim 241. Additionally, the target 240 may be in the same horizontal plane as front rim 30 or raised above the plane of the rim 30 to also aid in visualization. This may be done by tilting target 240, providing an additional target, as in FIG. 6, or simply raising the illuminated structure, or portion of the structure, to an elevation above the rim 30 to aid in the visualization of the vertical aiming axis of target 240 and still be suggestive of the center or aiming point of the target 240 which resides on the same center line as the center point of the rim 30 and is in the same center plane. Alternatively, a post, a pole, stakes or spears for example may be utilized alternatively to the rim 241. The figure further depicts a basketball B with flight path shown in broken line having a first, short-long pattern. A second broken line pattern extends through the backboard 12 showing an intended path through the rear target 240 as if the rigid surface of the backboard 12 would not interrupt and deflect the flight path of the basketball B. This second line is an intended flight line of the ball through the center of the rear target (the aiming line) and the first short-long line depicts the initial, then altered flight path of the basketball B following banking off of the backboard 12.

Figure 9:
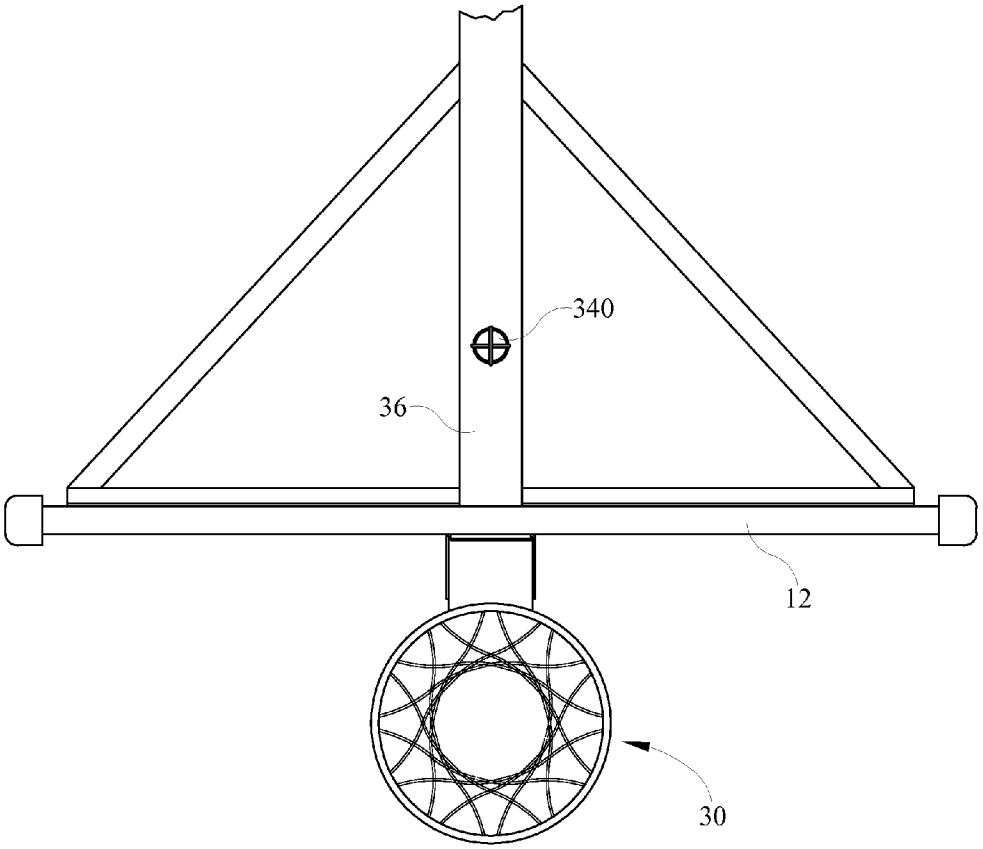
FIG. 9 is a top view of a basketball goal utilizing an alternative rear target.

Referring now to FIG. 9, a top view of an alternative target 340 is depicted on an exemplary basketball goal. Positioned behind the rear of the backboard 12, is the target 340 which is embodied by one or more lights, being white, clear or one or more colors, static or flashing. The light is positioned on the beam 36 but may be connected to, or extend from, any other structure or support of the basketball goal. The target 340 may be used alone, as shown, or may be used in addition to any other target structure, such as a rim, or net, as shown in the previous or subsequent embodiments. The light 340 is positioned at a distance from the front surface of the backboard 12 as the center of the rim 30. Further, the light may be tall or short as shown. The light should be positioned in such a way as to direct the shooter's aiming point approximately to a point rearwardly of the backboard 12 on the same center line and in the same plane as the center point of the front rim 30. Although some or all of the light may be above or below such plane, its position above and/or below shall be such as to direct the bank-shot-shooter's visualization of the target to a point behind the backboard 12, lying perpendicular to the plane of backboard 12 and on the same centerline of front rim 30, at the same distance rearwardly as is the center point of front rim 30, and in the same plane. As previously discussed, the shooter aims at the rear target 340 and by aiming at such rear target, the flight path of the basketball will carry the ball into the rigid backboard 12 and deflect the ball into the front rim 30.

Figure 10:
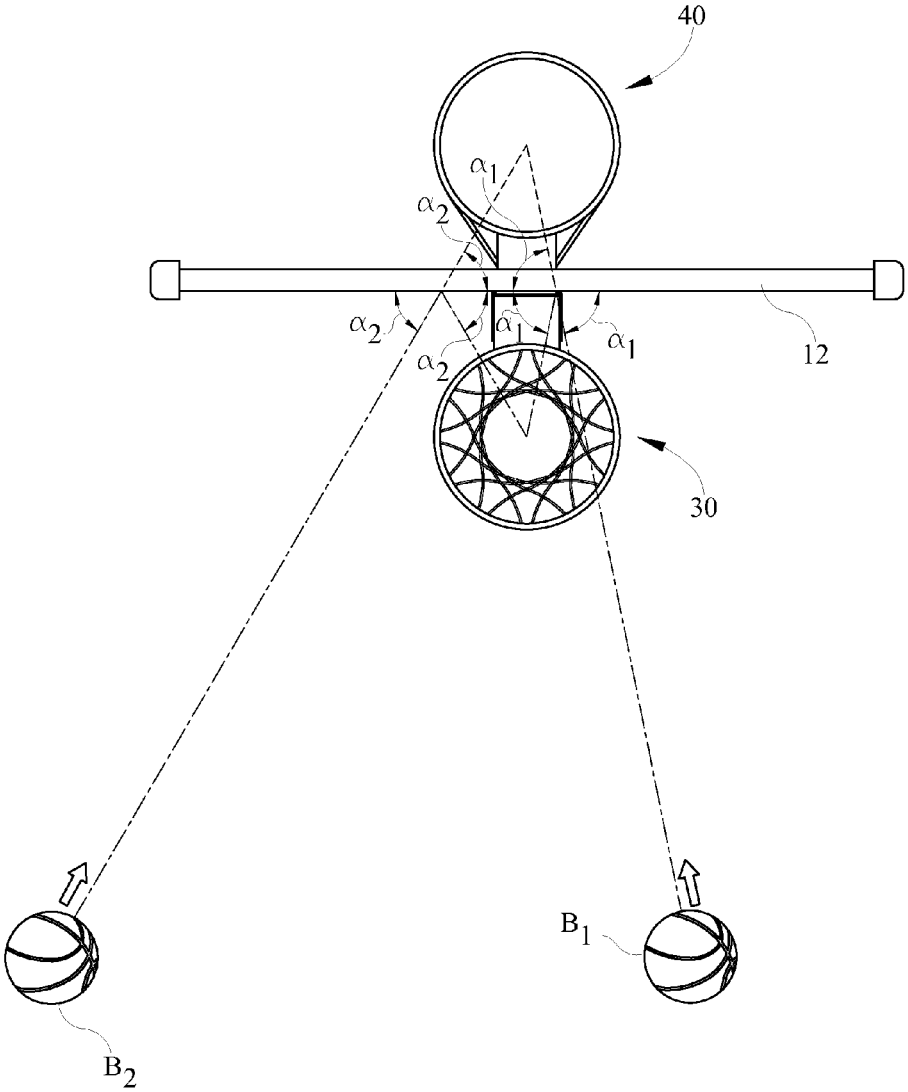
FIG. 10 is a top view of a basketball goal utilizing the instant device and showing two balls with flight path lines and bank flight path lines.

Referring now to FIG. 10, a top view of a basketball goal is shown with paths of two basketballs for illustration of the method of using the rear target 40 for shooting a bank shot, which target is independent of the bank-shot-shooter's location or motion on the court at the moment of shooting. As shown, a first basketball $B_1$ is shown with a flight path aimed at the center of a rear target 40. The path of the basketball intersects the backboard 12 having a reflected path into the front rim 30. The angle is depicted as $\alpha_1$ and is generally the same before and after engaging backboard 12 since the loss of energy due to friction, deflection of the basketball or spin is, in the normal bank shot, assumed to be relatively small.

Similarly, a second basketball $B_2$ is shown moving toward the center point of the rear target 40. The basketball has a flight path toward the center of rear target 40. However, due to the angle $\alpha_2$ of the flight path relative to the backboard 12, the basketball $B_2$ reflects on a different angle than basketball $B_1$. It should be understood that angles $\alpha_1$ and $\alpha_2$ are measured relative to the backboards and are aimed at the same axis or center of rear target 40. Nonetheless, the basketball $B_2$ actually travels into the centerline vertical axis of the front rim 30. In these examples, the ball travels into the backboard at a first angle and reflects from the backboard generally at the same angle, as depicted. In both examples the target is the same, and the result is the same. However, it shall be noted that even though the balls are "shot" from different locations relative to the backboard 12, the target is singular and, regardless of where the shooter is located, is independent of the shooter's location or motion. One skilled in the art should realize that these examples are shown in top view and therefore do not represent the angle of the ball's approach in a vertical plane or axis as shown in FIG. 3. Angles through the vertical plane, or relative to a vertical axis, that is angle $\Sigma$ as previously discussed, may vary but such properly aimed flight path will pass through or intersect the center or aiming point of the rear target 40, such as, for example, as shown in FIGS. 3 and 10.

Figure 11:
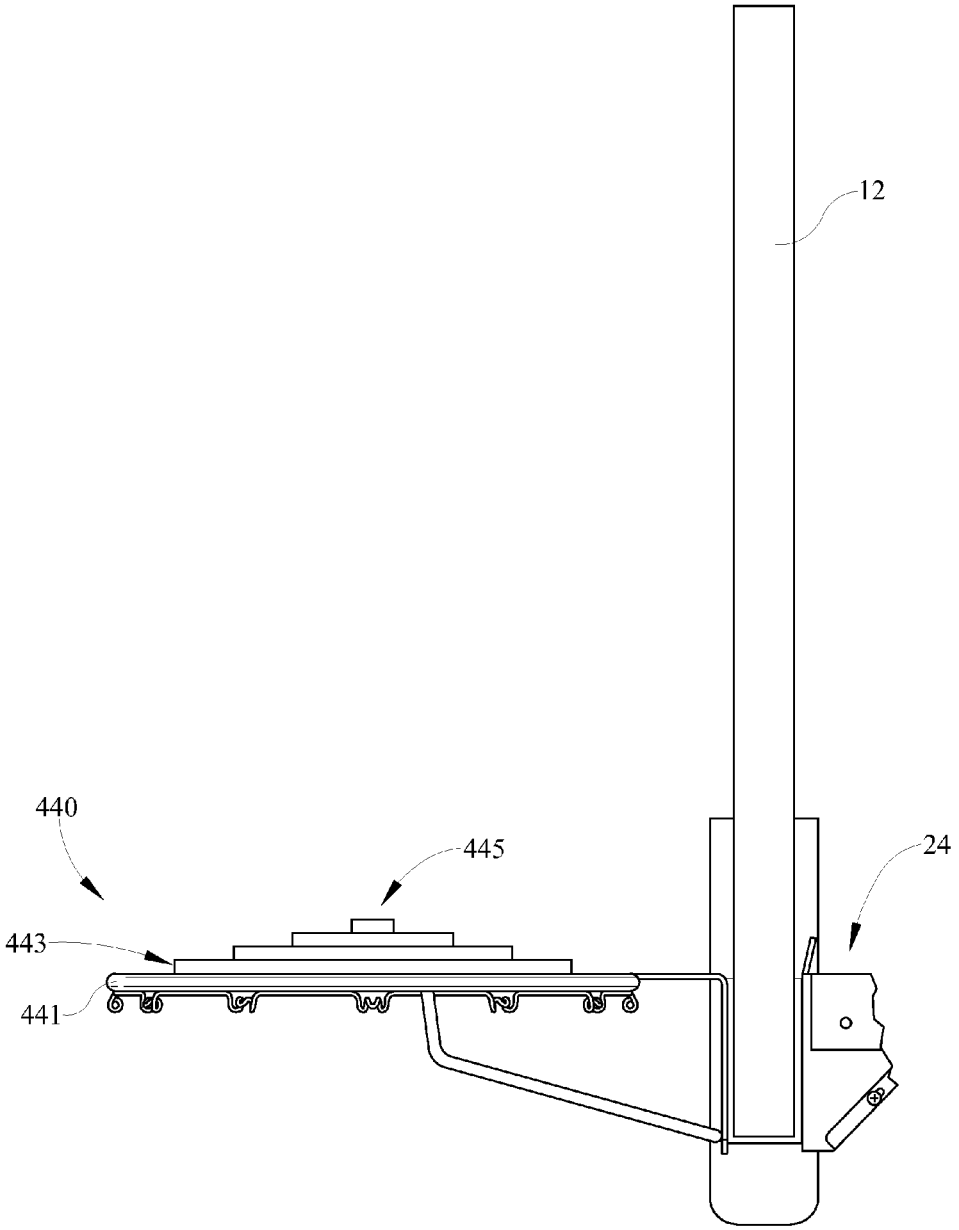
FIG. 11 is a side view of a further alternative embodiment of a rear target.

Referring now to FIG. 11, a side view of an alternative embodiment of rear target is depicted. The rear target 440 is shown including a rim 441. Extending from the rear of backboard 12, target 440 includes a stair-stepped structure generally approximating a conical aiming structure 443. The top of the aiming structure 443 may be centrally positioned relative to the rim 441. As with previous embodiments, the top 445 of the aiming structure 443 is aligned with the center of rim 30 in a direction perpendicular to the front or rear surfaces of backboard 12 and is in the center plane as previously described. At the top of, along or integral with the conical aiming structure 443, a luminaire may be positioned to aid in drawing the shooter's eye to the center point of the target 440. However, various types of luminaires may be used at various locations on or about structure 443 in order to draw the shooter's attention to the center axis and aiming point of the rear target 440. It should be understood that although the term conical is used, it is merely exemplary. The base of the structure may vary in shape or size with the shape of the rim 441 or may be used with other structures, such as the net or embodiments shown.

Figure 12:
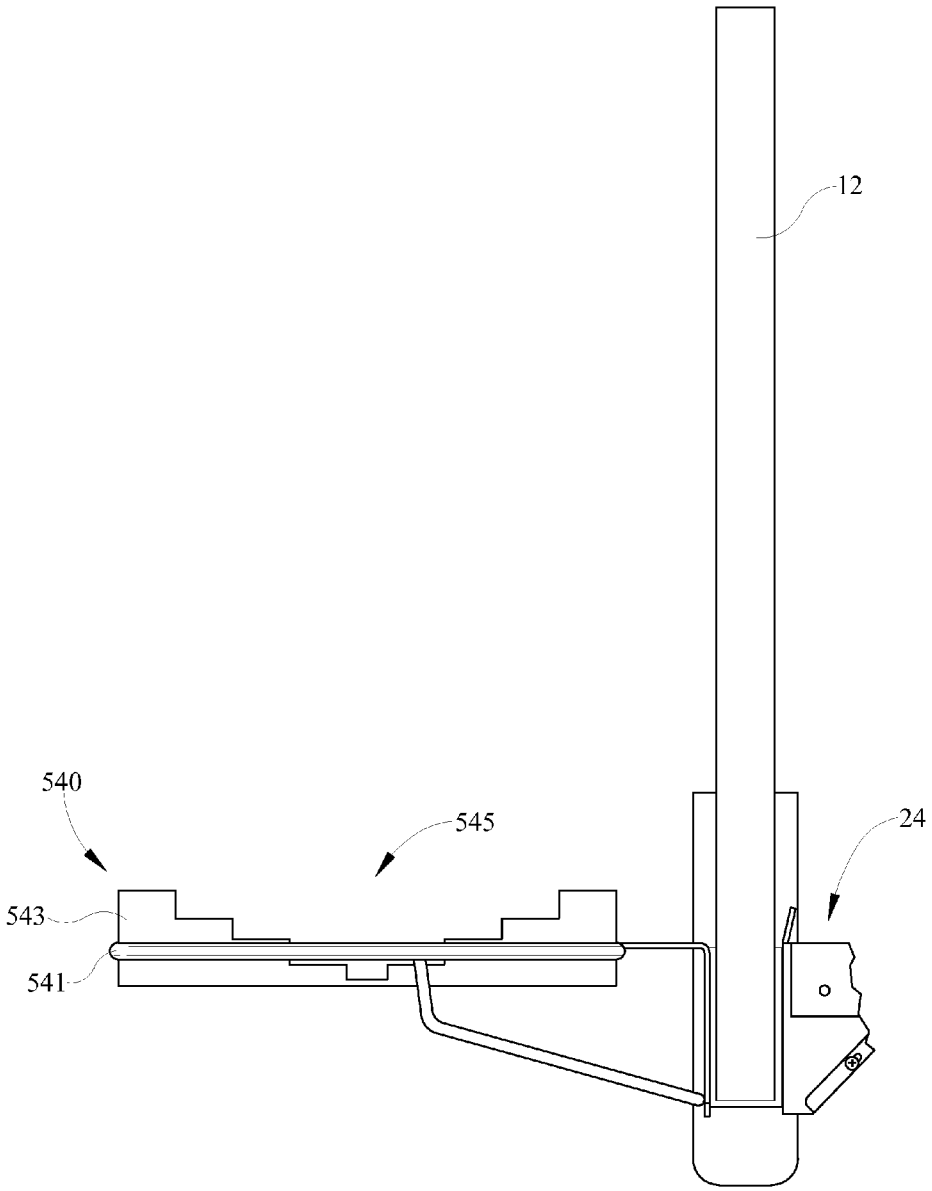
FIG. 12 is a side view of an even further alternative embodiment of a rear target.

Similarly, referring to FIG. 12, an alternative embodiment is depicted wherein a rear target 540 includes an aiming structure 543. In this embodiment, the aiming structure 543 steps down from a higher peripheral edge to a lower central location 545. This central location may be at, above or below the elevation of the front rim 30 or rear rim 541. The aiming structure is positioned on the rim 541. As with the other embodiments, it may be desirable to position the lower central point 545 at the same distance from the front surface of the backboard 12 as the center point of the front rim 30. Additionally, these points are aligned in a direction perpendicular to the backboard surfaces and are on the same centerline as the center point of front rim 30, which is perpendicular to backboard 12. It should be clear that the aiming structures 443 and 543 may be used with or without the rim embodiments depicted and may be of differing size than that which is depicted. Further, although the center points of these targets 445, 545 may be at different elevations at, above or below, the center point of front rim 30, the shooter's aim is drawn by these targets to the center point of such targets so as to aid the shooter to bank a basketball into the center of the front rim 30.

Figure 13:
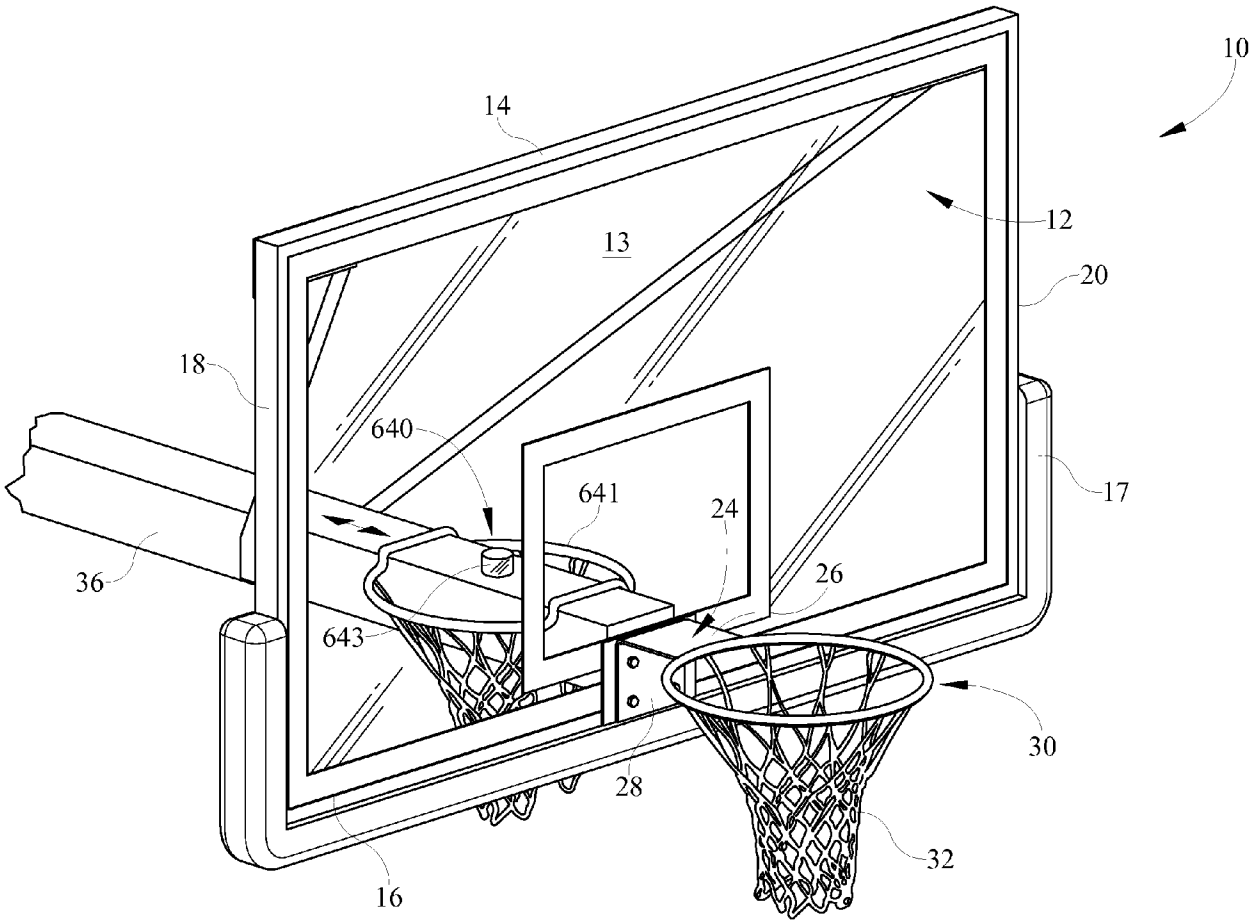
FIG. 13 is a perspective view of still an even further embodiment of a rear target.

Referring now to FIG. 13, a further alternative embodiment of a rear target 640 is depicted. The rear target 640 is also in the form of a rim 641 but the rim is not circular in shape and such rim should not be considered limiting. The rim 641 has a saddle structure to sit over the support beam 36 and allows for adjustability toward or away from the backboard 12. In the embodiment depicted, the beam is at or above the rim 30 so the saddle shape allows positioning of the rim 641 at the same elevation as the rim 30. Optionally, a painted structure or a lighted structure 643 may be positioned centrally within the rim 641 and draw the shooters aim toward the central axis, central point or center of the target 640.

Figure 14:
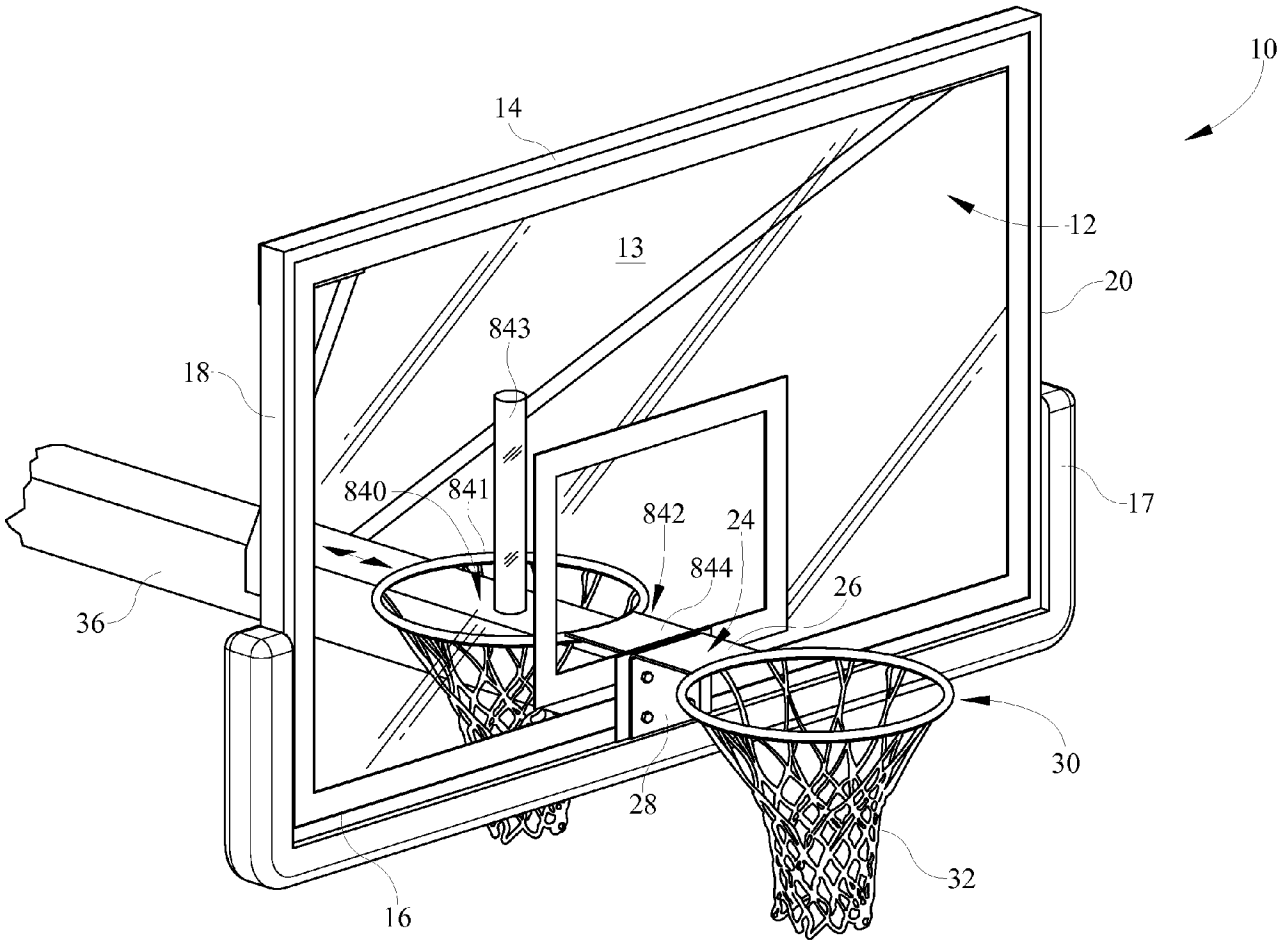
FIG. 14 is a perspective view of a yet further embodiment of a rear target.

Referring now to FIG. 14, a perspective view of a basketball goal with rear target 840 is shown including a painted or illuminated structure 843 differing in shape from those of FIGS. 9 and 13. In the instant figure, the target 840 is cylindrical, although not limited to such, in shape and is taller than the previous embodiment in order to aid the shooter in seeing the center of the target 840. This effectively raises the target 840 while still providing an indication of the center or center axis of the target 840 such as depicted by the flight path examples of balls $B_1$ and $B_2$ in FIG. 10. It is desirable that the target aid the shooter in visualizing the point aligned with the center line of front rim 30 at a position about fifteen (15") inches behind the front surface of backboard 12. This is one manner of doing such.

Figure 15:
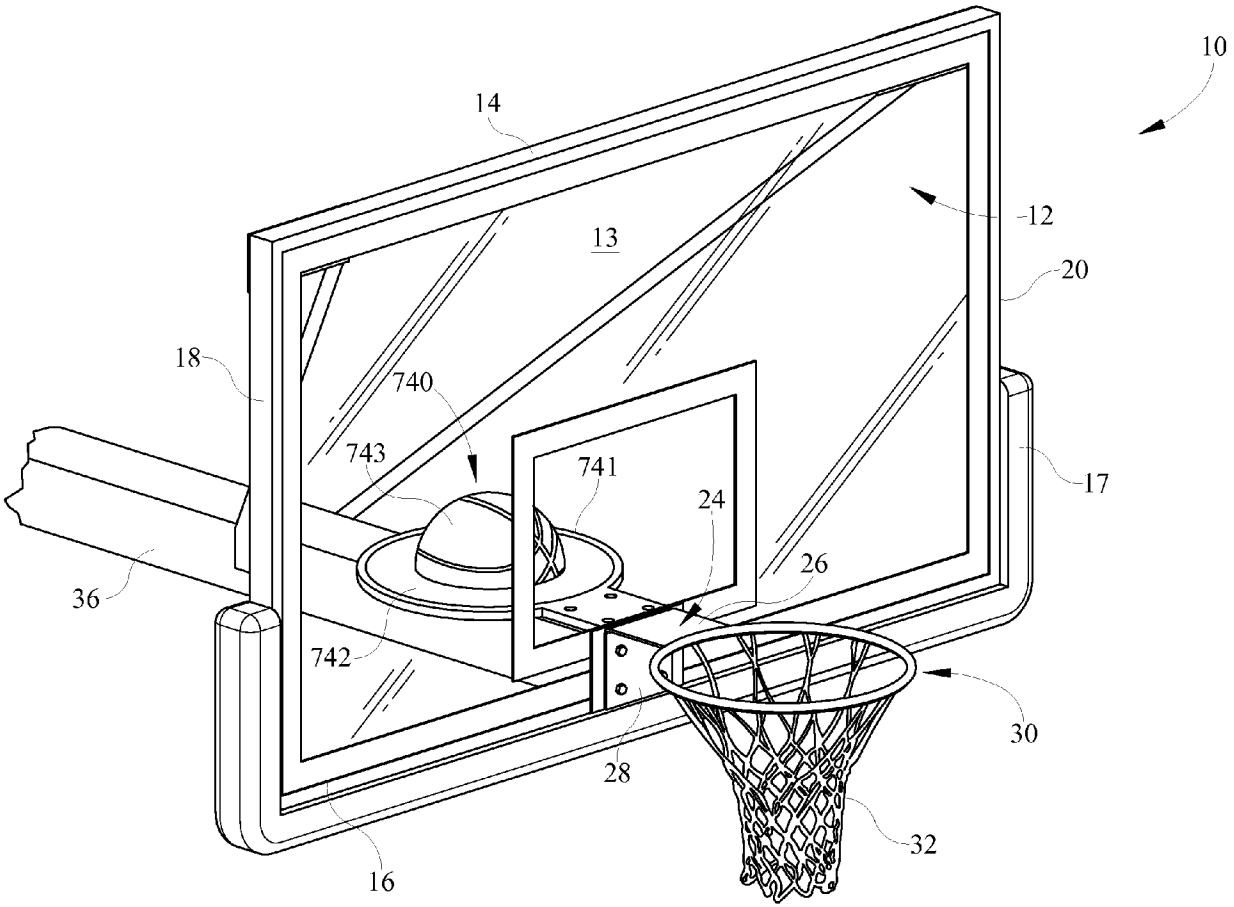
FIG. 15 is a perspective view of still yet an even further embodiment of a rear target.

Referring now to FIG. 15, a still further alternative embodiment of a rear target is shown in perspective view. The rear target 740 includes a generally circular shaped rim portion 741. The rim however need not be circular as previously discussed. The rim 741 is also not hollow but instead includes a flat surface 742 extending across. Extending from the upper surface 742 is a domed hemispherical structure 743 similar in appearance to a partial basketball which may or may not be regulation size. However, the exemplary basketball is only hemispherical in shape so that the shooter's aim is again drawn to the center of the target 740. Like other embodiments, this instant embodiment may or may not include a net or central post structure for increased depth perception for the shooter.

Figure 16:
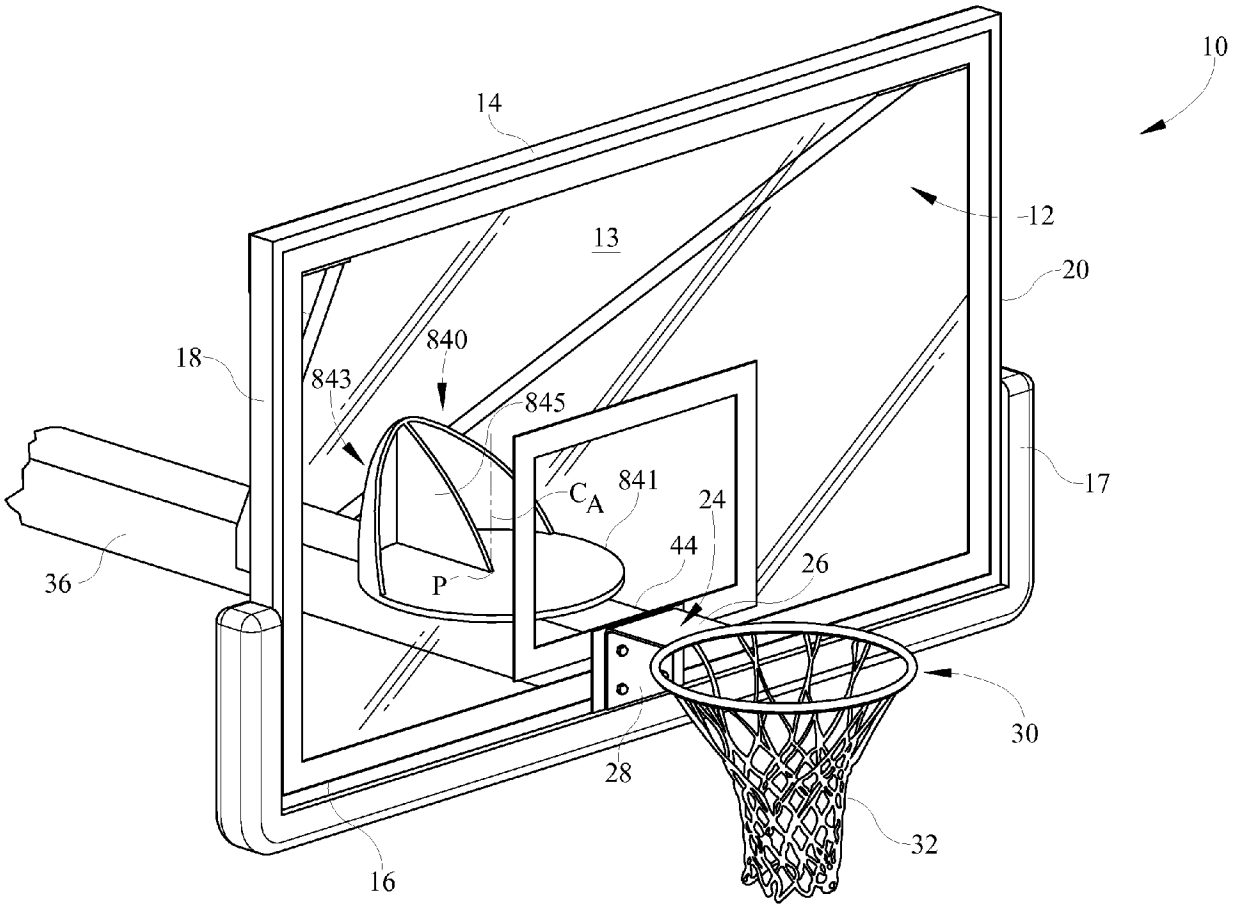
FIG. 16 is a perspective view of an additional alternative embodiment.

Referring now to FIG. 16, the embodiment depicts a backboard 12 as previously described with a front rim 30 connected by a bracket or other assembly. A rear target 840 includes a rim 841 and a scoop or cowling 843. The rim 841 may be open or closed with a solid top surface as with previous embodiments. A point P is found at the central portion of the rim 841 and such point is about fifteen inches (15") from the front surface of backboard 12. The scoop 843 is generally concave and follows the curvature of the rim 841. The scoop 843 is also curvilinear in shape as along the top edge of the scoop 843, however such top edge description is not limiting as other edge designs may be utilized. Extending from a central portion of the scoop 843 is a fin or divider 845. The fin 845 extends from a central rear location of the scoop 843 towards the point or center point P of the rim 841. The fin 845 acts as a divider which the shooter can utilize to shoot at the left half of the target 840 when shooting from the left side of the front rim 30 and alternatively can shoot at the right hand side of the target 840 when shooting from the right hand side of the rim 30. As previously stated, the point P resides on a line extending perpendicularly to the front surface of the backboard 12 from the center of front rim 30 toward the center of the rear rim 841 and within a vertical plane which extends through the backboard 12, as with the previous embodiments. Thus the fin 845 aids the shooter to locate the point P at which the shooter aims and, with a path intending to pass through such point the basketball will bank from the backboard 12, through the front rim 30. The fin 845 may be used with or without the scoop 843, according to the instant embodiment.

Figure 17:
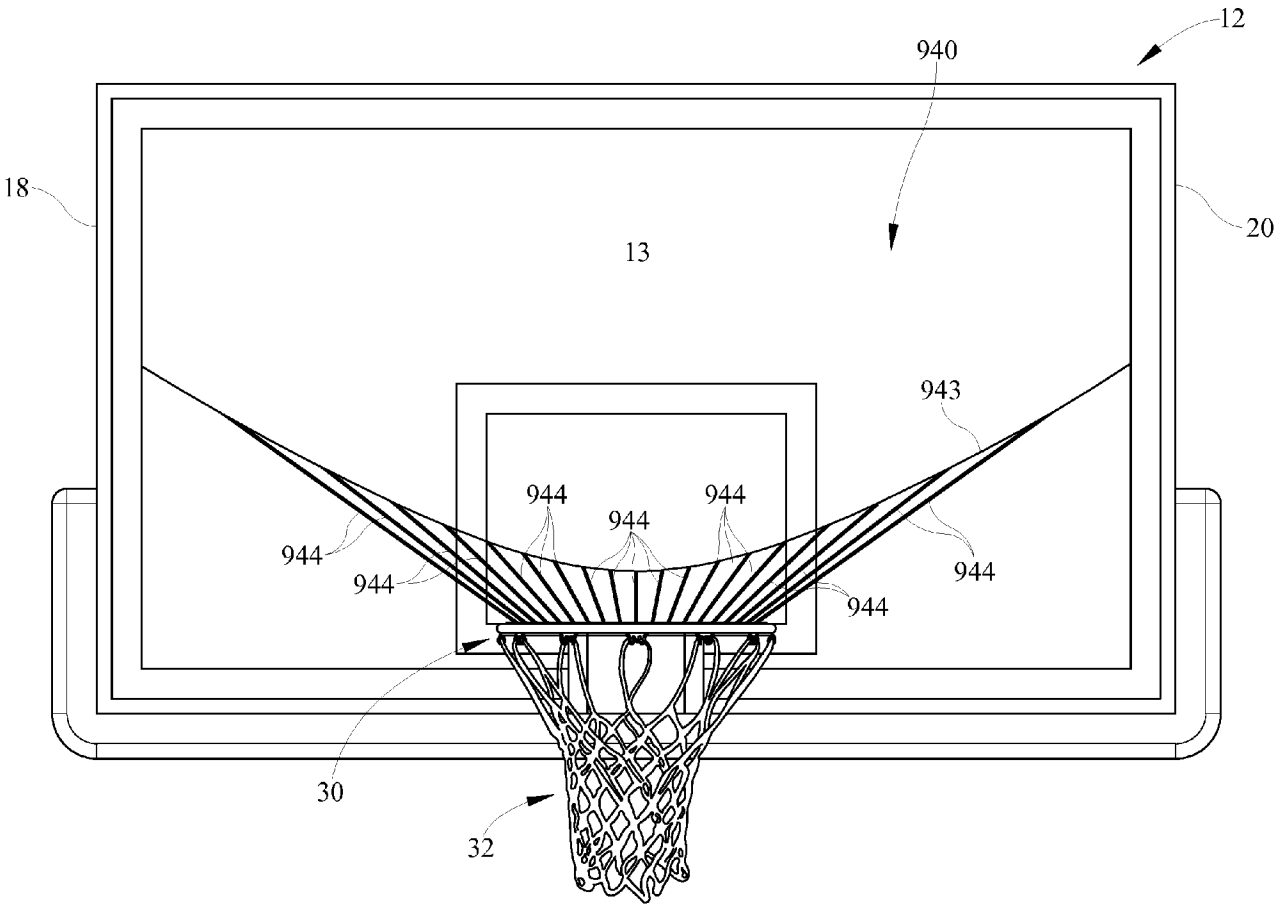
FIG. 17 is a front view of a basketball goal with a minimum height impingement line formed by a plurality of projections.

With reference now to FIG. 17, a further embodiment of a basketball training aid is provided. In addition to any of the previously cited embodiments or aiming aids which are located generally behind the backboard 12, the instant embodiments provide for application of a minimum impingement height line 943, which defines a minimum height at which a basketball should bank or impinge on the backboard 12 when shot at any of the rearwardly positioned aiming aids previously described in order to make a shot. This provides an additional visual aid that a user may utilize during practice in order to learn the bank shot and improve shooting percentage.

The minimum impingement height line 943 is formed by extending a plurality of projections 944 which extend from the periphery of the basketball rim 30 upwardly at an angle of greater than or equal to 32 degrees. Geometric analysis has shown that the chances of passing a basketball through a basketball rim without touching the rim, commonly referred to as a "swish" shot, increases when the basketball passes through the rim at an angle of at least 32 degrees, as measured from the horizontal line. The projections 944 impinge upon the backboard surface 13 to define the minimum height impingement line 943. Thus, when shooting a bank shot, the user has a target aiming line passing through the rear target, any of which have been previously described for example, and will aim to bank the basketball at or above this minimal height impingement line 943 in order to bank the ball through the rim 30 at an angle of at least about 32 degrees. In effect, the minimum height target line 943 provides a location wherein the basketball should intersect the backboard surface 13. If such point is along the target line through the rear target, the basketball should pass through the rim 30 with a high likelihood of not touching the rim 30.

Figure 18:
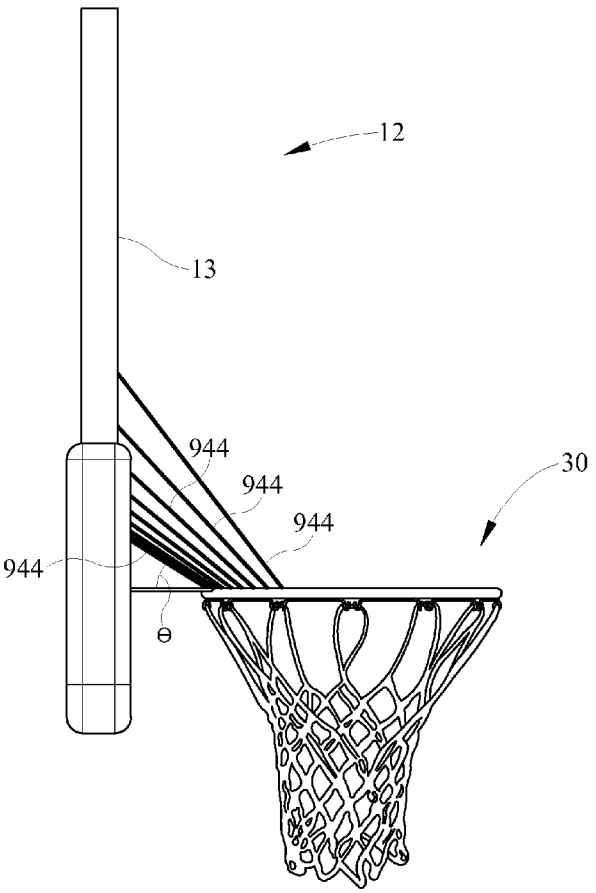
FIG. 18 is a side view of the basketball goal of FIG. 17 including the projections extending from the rim.

Referring now to FIG. 18, a side view of the backboard 12 is depicted including the front surface 13. The front rim 30 is depicted extending from the backboard as is known in the art. The embodiment depicts a plurality of projection lines 944 extending from the periphery of the rim 30 rearwardly to the backboard surface 13. These projections 944 all extend at an angle Θ. The angles may appear to be of differing values, but this appearance is due to the changing location at tangent points along the rim 30 from which the projections 944 extend. According to the instant embodiments, the angle Θ is disposed at an angle of greater than or equal to 32 degrees. This minimal height impingement line 943 (FIG. 17) is a point or plurality of points at which the basketball should bank, while traveling on a line toward a rear target, and pass through the rim 30. If the basketball impinges the backboard 12 above the line 943, the reflected path of the basketball will be at least 32 degrees, increasing the chance of passing through the rim 30 without touching. Again, as the ball passes through the rim at the angle of at least 32 degrees, the likelihood of the ball touching the rim 30 and altering the shot direction decreases thus increasing the likelihood of making a basket or goal.

Figure 19:
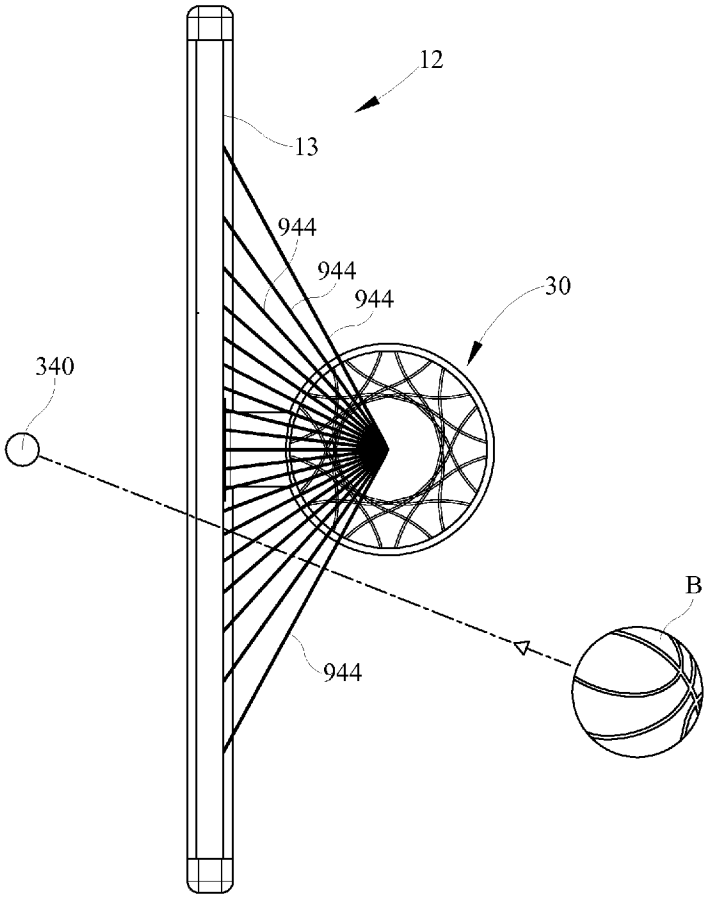
FIG. 19 is a top view of the basketball goal of FIG. 17.

Referring now to FIG. 19, a top view of the backboard 12 and rim 30 is depicted. The projection lines 944 start from the center point of the rim 30 and extend horizontally toward the backboard 12 until they intersect with the periphery of the rim 30. At the rim 30, the projection lines 944 extend upwardly at the angle Θ (FIG. 18) as previously discussed to intersect with the front surface of backboard 13 and define the minimum height line 943 (FIG. 17). As the impingement points projection lines on the backboard are joined, to define the minimum impingement height line 943, which may be of various forms defined herein, such as temporary, permanent, stencil form or a line on the backboard, either applied as part of the overlay or formed through use of the overlay. Further, the line 943 may be curvilinear or arcuate according to various embodiments or linear with some approximations of the line formed by the projection points.

A basketball B is shown moving toward the rear target, indicated, for example, as 340. It should be understood, however, that while representative embodiment 340 is depicted, any of the previously described target embodiments may be utilized as a rear target in combination with the minimal height target lines described in the instant embodiments. When the basketball B impinges on the backboard surface 13 above the minimum height target line 943 while on a line toward the rear target 340, the basketball B will reflect from the backboard 12 at an angle of at least 32 degrees through the rim 30 scoring a basket.

Figure 20:
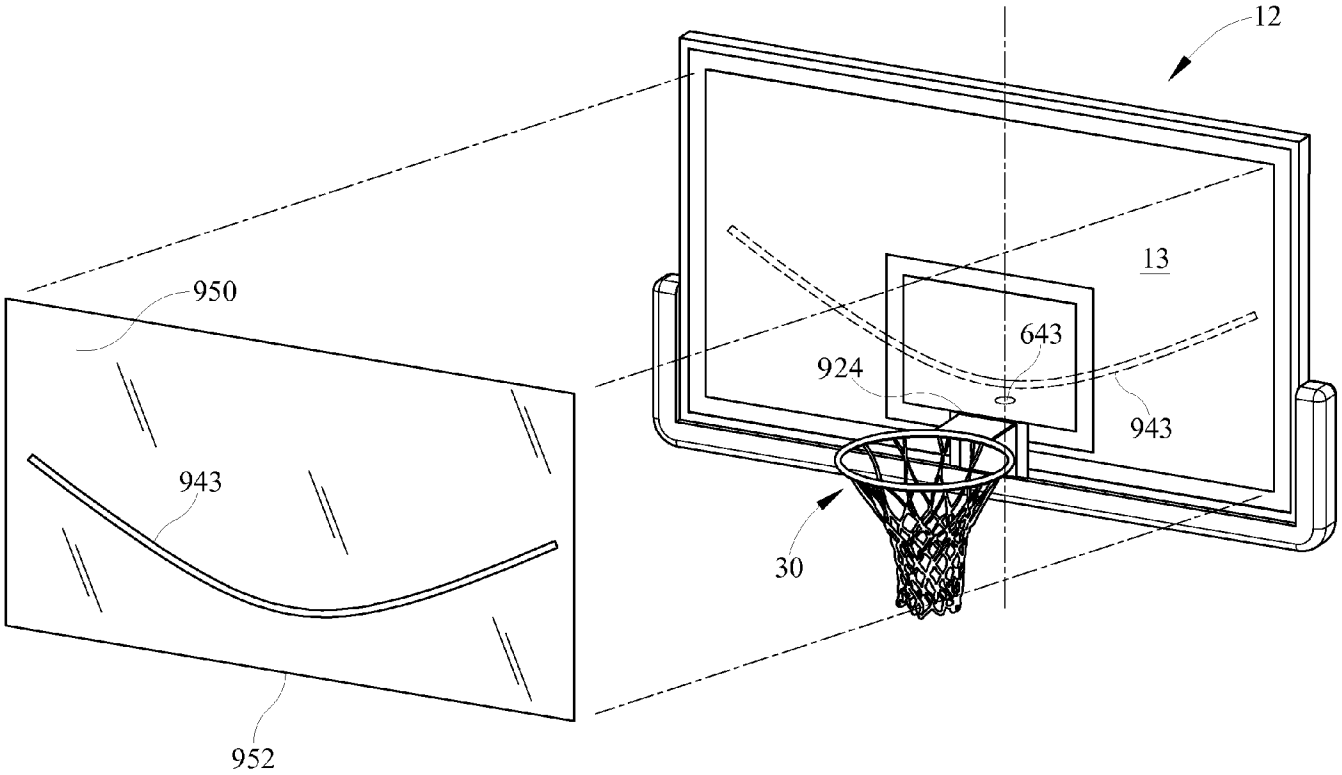
FIG. 20 is an embodiment of an overlay for using the minimum height impingement line.

One skilled in the art will understand that the previous views have shown how the minimum height line 943 is developed from the plurality of projections 944. The following description and views however provides various structures and methods of actually using such line. Referring now to FIG. 20, an isometric view of one method of applying the minimum height line 943 to a backboard 20 is depicted.

Referring first to the backboard 12, a broken line is depicted on the backboard and represents the minimum height target line 943. This line may be painted, formed by tape or other known marking material directly to the backboard surface 13. While it may be desirable to some to place a permanent mark on the backboard, it may not be desirable for others such as within gymnasiums where official games are played to place such mark in a permanent manner on the backboard. Alternatively, therefore, the line 943 may be placed on the backboard in a temporary fashion, such as by grease marker, or chalk mark or other fashion which may be erased or removed for official game play. The minimum height target line 943 is shown in broken line so as to distinguish from the alternate embodiments described further herein.

According to other embodiments, and still referring to FIG. 20, an overlay 950 may be utilized to provide the marking on the backboard 12. To the left of the backboard 12, the overlay 950 is depicted as a transparent material which may be applied to the backboard from surface 13. The overlay 950 is generally rectangular in shape with a bottom edge 952 which may be seated on the rim support 924. In this embodiment, while the overlay 950 is rectangular, various shapes may be utilized and it should be understood that positioning the overlay on the rim support 924 is merely one embodiment which may be utilized. This such embodiment is convenient because the position of the rim 30 and the rim support 924 relative to the backboard 12 is generally consistent dimensionally as such are standard for most basketball goals.

The overlay 950 may be a decal which is applied by an adhesive material to the backboard 12. The adhesion may be of a permanent type or temporary type. In the instant embodiment, such overlay 950 may be applied such as by static adhesion or as a removable type decal to the front surface 13. Alternatively, such overlay 950 may be permanently applied, if desirable, and if permanent adhesion is not problematic for official basketball games. The overlay 950 may be square or rectangular as shown, or may alternatively be shaped soley to match the shape of the line 943 or window/stencil for defining the line 943 on the backboard 12.

Figure 21:
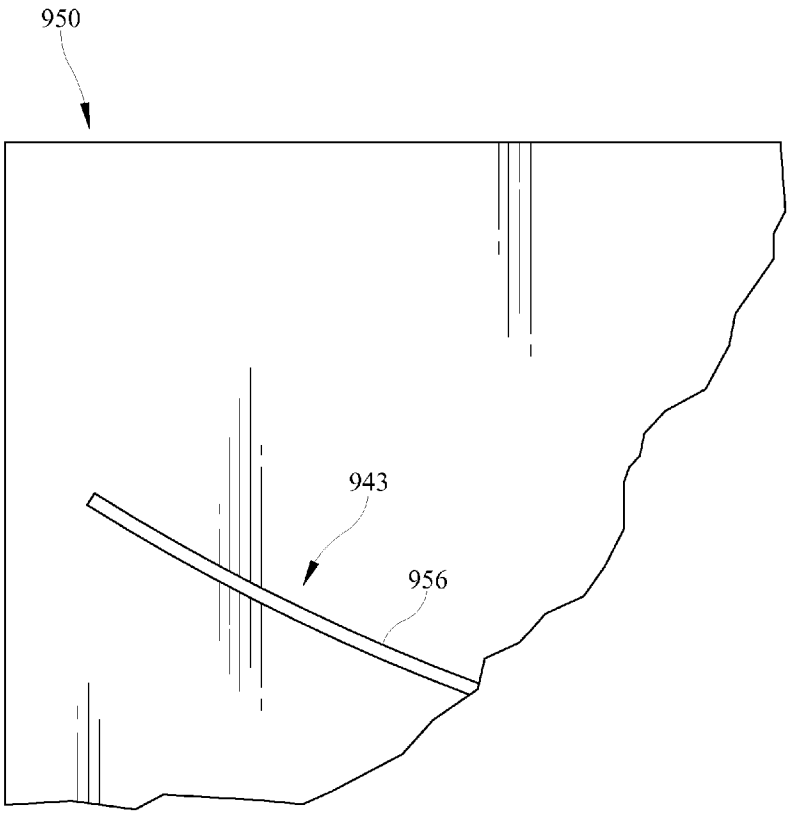
FIG. 21 depicts one embodiment of an overlay with an opening for forming the minimum height impingement line.
Figure 22:
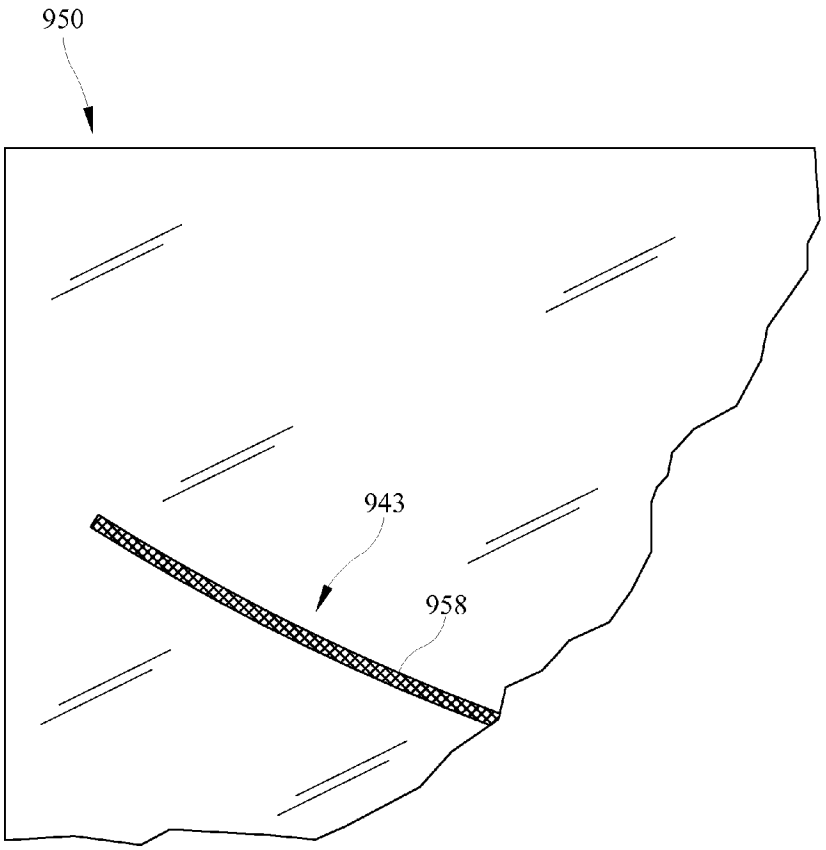
FIG. 22 depicts another embodiment of an overlay.

With additional reference to FIGS. 21, 22, portions of the overlay 950 are shown. The minimum height line 943 is represented by an opening 956 through the overlay 950. In such embodiment, the overlay 950 acts as an opening or stencil wherein a marker, soap, chalk, shoe polish or other removable marking material may be utilized to color a line on the backboard 12. After the line 943 is applied through the opening 956 and formed on the backboard 12, the overlay 950 may be removed if desirable.

According to the embodiments shown in FIG. 22, an alternative minimum height line 943 is shown as a painted or marked line 958 on the overlay 950. In this embodiment, the overlay 950 is positioned on the backboard 12 and may remain on there either permanently or temporarily, for example for practice only. In either of these embodiments, one skilled in the art should realize that the overlay 950 may be transparent, semi-transparent or need not be transparent in the occasion where the overlay 950 will be removed after application of the minimum height target line 943 to the backboard 12 and further depending on whether the overlay 950 will remain on the backboard.

Additionally, the overlay 950 may be applied to the rear surface of the backboard 12 since most backboards are transparent. In such embodiment, it may be more desirable to leave the overlay 950 on the rear surface in structures and goals where official games are not played, for example in practice facilities. Additionally, the overlay 950 will not receive wear-and-tear from basketballs hitting the material during practice, but still provides the minimum height target line 943 for banking or impinging the basketball on the backboard 12. In such embodiment, it also should be understood that the rear target, for example 643 (FIG. 20), should still be visible after application of the line 943 either on the backboard 12 or by application of the overlay 950 to the backboard 12. It should be understood therefore that the line or window for forming a line may be linear, arcuate or curvilinear in form.

Figure 23:
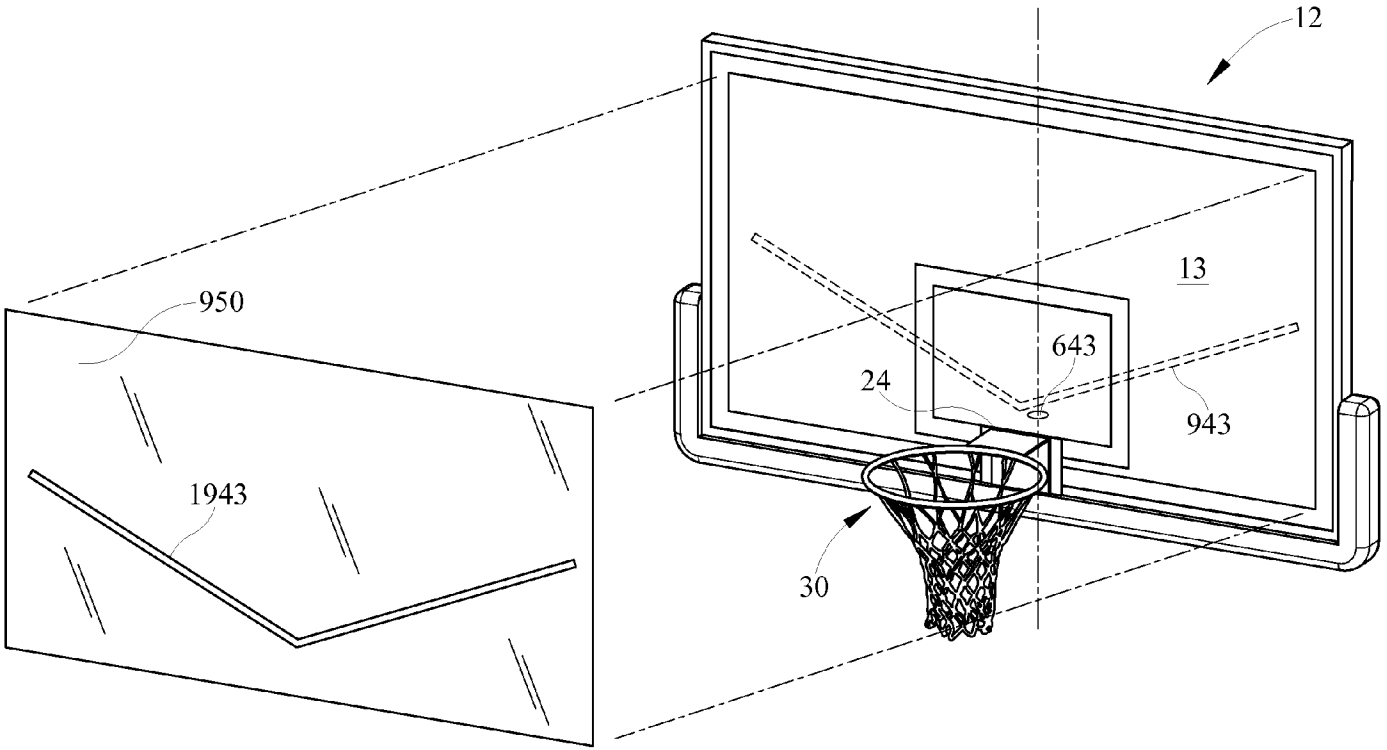
FIG. 23 depicts an overlay having an alternative minimum height impingement line.

Referring now to FIG. 23, an alternate minimum height line 1943 is depicted wherein the line is comprised of linear segments rather than the curved segment of the previous embodiment. The linear segments 1943 generally define a V-shape. The segments are formed by approximating the projections onto the minimum angle of 32 degrees. However, this approximation may not be as exact as the curved segment 956 of the previous embodiment.

Thus, it will be clear to one skilled in the art that the instant embodiments provide a rear target which aids in aiming a basketball for a bank shot as well as a minimum height line which may be applied or utilized in a variety of manners to aid the shooter by visually indicating where the basketball should bank while on a line to the rear target so as to increase the odds of making such bank shot.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. An aiming aid for shooting basketball bank shots, comprising:

a transparent backboard having a front surface, a rear surface and a thickness;

a first circular rim extending from said front surface of said backboard in a horizontal plane perpendicular to said backboard;

said first circular rim having a center point positioned on a centerline extending perpendicularly through said backboard, said center point positioned a first distance from said front surface of said backboard;

a target spaced rearwardly from said rear surface of said backboard, said target having a point positioned a second distance from said front surface of said backboard, said point positioned within a vertical plane, said vertical plane encompassing said centerline;

a removable overlay positioned on one of said front surface or said rear surface of said backboard, said overlay having one of a minimum height line or a mark-through opening corresponding to said minimum height line, said minimum height line and said mark through opening being defined by a plurality of radial projections extending from tangent points of said first circular rim, said radial projections being projected at an angle of at least 32 degrees from said tangent points of a rearward side of said first circular rim closer to said backboard; and, said target and said minimum height line disposed such that when a basketball impinges said backboard: (a) at a point above said minimum height line and (b) on a ball flight path through said target, said basketball will reflect through said first circular rim.

2. The aiming aid for shooting basketball bank shots of claim 1, wherein the overylay comprises said mark-through opening and wherein said overlay is removable when said minimum height line is formed on said backboard.

3. The aiming aid for shooting basketball bank shots of claim 1, wherein said overlay is removably adhered to said backboard.

4. The aiming aid for shooting basketball bank shots of claim 3, wherein said overlay is removed when said minimum height impingement line is formed on said backboard.

5. The aiming aid for shooting basketball bank shots of claim 1, wherein said overlay is a decal.

6. The aiming aid for basketball bank shots of claim 1, wherein said overlay is supported along a bottom edge.

7. The aiming aid for basketball bank shots of claim 1, wherein said overlay is adhered to said one of said front surface and said rear surface of said backboard.

8. The aiming aid for basketball bank shots of claim 1, wherein said mark-through opening defines a stencil for forming a line on said backboard.

9. The aiming aid for basketball bank shots of claim 1, wherein said at least 32 degree angle is between 32 and 90 degree.

10. The aiming aid for basketball bank shots of claim 1, wherein the overlay comprises said minimum height line, and wherein said minimum height line is curvilinear.

11. The aiming aid for basketball bank shots of claim 1, wherein the overlay comprises said minimum height line, and wherein said minimum height line is formed of linear segments.

12. The aiming aid for basketball bank shots of claim 1, wherein the overlay comprises said minimum height line, and wherein said minimum height line is generally V-shaped.

13. An aiming aid for shooting basketball bank shots, comprising:

a transparent basketball backboard;

a front rim extending toward a basketball playing area;

a target positioned behind a rear surface of said backboard, said target positioned a first distance from a front surface of said backboard which is substantially equal to a second distance from said front surface of said backboard to a point within a circumference of said front rim;

said target positioned one of along, above, or below a centerline extending from said front rim through said backboard and toward said target;

wherein said target is independent of the shooter's position at which to aim when shooting a bank shot;

an overlay positioned on one of said front surface or said rear surface of said backboard, said overlay having a minimum impingement height line, wherein said minimum impingement height line is defined by a plurality of radial projections extending from a rearward periphery of said first circular rim toward said backboard, said projections projected at an angle of at least 32 degrees from said rearward periphery of said first circular rim; and, said target and said minimum impingement height line disposed such that when a basketball impinges said backboard at a point above said minimum height line and along on a ball flight path through said target, said basketball will bounce through said first circular rim.

14. An aiming aid for shooting basketball bank shots, comprising:

a first circular rim connected to a backboard for shooting basketballs, said first circular rim having a first center point;

a rear target disposed on a side of said backboard opposite said first circular rim, said rear target having a second point;

said first center point of said first circular rim disposed a first distance from a front surface of said backboard;

a center line extending between said first circular rim and said second point, said second point and said center line disposed within a plane;

said second point of said rear target disposed a second distance from a rear surface of said backboard, in the direction of said center line, perpendicular to a front surface of said backboard;

an overlay positioned against said backboard, said overlay including a minimum impingement height line thereon for banking a basketball against said backboard;

said minimum impingement height line defined by a plurality of projections extending rearwardly from said first circular rim toward said backboard at an angle of at least 32 degrees;

said rear target and said minimum impingement height line arranged such that when a basketball impacts said backboard at a point above said minimum height line and along a basketball flight path through said rear target, said basketball will bounce through said first circular rim.

15. The aiming aid for shooting basketball bank shots of claim 14, wherein said minimum impingement height line is a line.

16. The aiming aid for shooting basketball bank shots of claim 15, wherein said line is curvilinear or includes at least one linear segment.

17. The aiming aid for shooting basketball bank shots of claim 14, wherein said overlay is disposed on one of said front surface or said back surface of said backboard.

18. The aiming aid for shooting basketball bank shots of claim 14, wherein said minimum impingement height line is a mark through window for forming a corresponding minimum impingement height line on said backboard.

19. The aiming aid for shooting basketball bank shots of claim 14, wherein said minimum impingement height line is applied either a permanently or removably.

20. The aiming aid for shooting basketball bank shots of claim 14, wherein said overlay is applied either permanently or removably.

* * * * *